US009395659B2

(12) United States Patent
Tanaka et al.

(10) Patent No.: US 9,395,659 B2
(45) Date of Patent: Jul. 19, 2016

(54) IMAGE FORMING APPARATUS

(71) Applicants: Shinya Tanaka, Kanagawa (JP); Hirokazu Ishii, Tokyo (JP); Tsutomu Kato, Kanagawa (JP); Yasufumi Takahashi, Kanagawa (JP); Takehide Mizutani, Kanagawa (JP); Osamu Ichihashi, Kanagawa (JP); Yuji Kato, Kanagawa (JP); Atsushi Nagata, Kanagawa (JP); Kazuosa Kuma, Kanagawa (JP); Ryo Hasegawa, Kanagawa (JP); Haruki Nagata, Kanagawa (JP); Naoto Kochi, Kanagawa (JP)

(72) Inventors: Shinya Tanaka, Kanagawa (JP); Hirokazu Ishii, Tokyo (JP); Tsutomu Kato, Kanagawa (JP); Yasufumi Takahashi, Kanagawa (JP); Takehide Mizutani, Kanagawa (JP); Osamu Ichihashi, Kanagawa (JP); Yuji Kato, Kanagawa (JP); Atsushi Nagata, Kanagawa (JP); Kazuosa Kuma, Kanagawa (JP); Ryo Hasegawa, Kanagawa (JP); Haruki Nagata, Kanagawa (JP); Naoto Kochi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/259,337

(22) Filed: Apr. 23, 2014

(65) Prior Publication Data

US 2014/0328604 A1 Nov. 6, 2014

(30) Foreign Application Priority Data

| | | |
|---|---|---|
| May 1, 2013 | (JP) | 2013-096272 |
| May 22, 2013 | (JP) | 2013-107856 |
| Oct. 11, 2013 | (JP) | 2013-213603 |
| Dec. 25, 2013 | (JP) | 2013-267522 |

(51) Int. Cl.
*G03G 15/16* (2006.01)

(52) U.S. Cl.
CPC ..... *G03G 15/1675* (2013.01); *G03G 15/1605* (2013.01)

(58) Field of Classification Search
CPC ..... G03G 15/0266; G03G 15/1675; G03G 15/5004; G03G 15/1665; G03G 15/50; G03G 15/80
USPC ..... 399/66, 297, 302, 308, 314
See application file for complete search history.

(56) References Cited

U.S. PATENT DOCUMENTS 5,515,146 A 5/1996 Harasawa et al.
5,631,725 A 5/1997 Harasawa et al.

(Continued)

FOREIGN PATENT DOCUMENTS

EP 2 498 135 A2 9/2012
JP 07-168403 7/1995

(Continued)

OTHER PUBLICATIONS

U.S. Appl. No. 14/173,122, filed Feb. 5, 2014.

(Continued)

*Primary Examiner* — Walter L Lindsay, Jr.
*Assistant Examiner* — Jessica L Eley
(74) *Attorney, Agent, or Firm* — Oblon, McClelland, Maier & Neustadt, L.L.P.

(57) ABSTRACT

An image forming apparatus includes an image carrier that carries a toner image; a transfer member that forms a transfer nip between the transfer member and the image carrier; and a power supply capable of outputting a superimposed transfer bias in which an alternating current component is superimposed onto a direct current component. The toner image on the image carrier is transferred onto a recording medium in the transfer nip by the superimposed transfer bias or a direct current bias consisting of the direct current component output by the power supply. The apparatus also includes a controller that controls the power supply so that an output target value of the direct current component when the direct current component rises up is larger than an output target value of the direct current component when the toner image is transferred onto the recording medium.

20 Claims, 18 Drawing Sheets

(56) References Cited

U.S. PATENT DOCUMENTS

| | | | | |
|---|---|---|---|---|
| 5,812,919 | A | 9/1998 | Takano et al. | |
| 5,822,667 | A | 10/1998 | Hayama et al. | |
| 5,930,573 | A | 7/1999 | Miyamoto et al. | |
| 6,188,862 | B1 | 2/2001 | Ishii | |
| 6,282,386 | B1 | 8/2001 | Ishii | |
| 7,906,264 | B2 * | 3/2011 | Takahashi et al. | 430/109.4 |
| 2003/0035658 | A1 | 2/2003 | Ishii | |
| 2003/0219296 | A1 | 11/2003 | Kabata et al. | |
| 2005/0084293 | A1 | 4/2005 | Fukuchi et al. | |
| 2005/0180767 | A1 | 8/2005 | Ishii et al. | |
| 2007/0003333 | A1 | 1/2007 | Ishii | |
| 2007/0127941 | A1 | 6/2007 | Ishii et al. | |
| 2009/0196638 | A1 | 8/2009 | Sukesako et al. | |
| 2010/0008687 | A1 | 1/2010 | Ishii | |
| 2010/0040386 | A1 | 2/2010 | Mizutani et al. | |
| 2010/0142985 | A1 | 6/2010 | Minbe et al. | |
| 2010/0221029 | A1 | 9/2010 | Minbu et al. | |
| 2011/0158690 | A1 | 6/2011 | Mimbu et al. | |
| 2012/0027447 | A1 | 2/2012 | Mukaibara | |
| 2012/0045231 | A1 | 2/2012 | Ogino et al. | |
| 2012/0045237 | A1 * | 2/2012 | Aoki et al. | 399/66 |
| 2012/0121293 | A1 | 5/2012 | Mimbu et al. | |
| 2012/0170951 | A1 | 7/2012 | Ishii | |
| 2012/0230715 | A1 | 9/2012 | Ogino et al. | |
| 2012/0237234 | A1 | 9/2012 | Sugimoto et al. | |
| 2012/0237260 | A1 | 9/2012 | Sengoku et al. | |
| 2012/0328314 | A1 | 12/2012 | Sugimoto et al. | |
| 2012/0328321 | A1 | 12/2012 | Takeuchi et al. | |
| 2013/0058665 | A1 | 3/2013 | Ishida | |
| 2013/0064559 | A1 | 3/2013 | Nakamura et al. | |
| 2013/0089363 | A1 | 4/2013 | Mimbu et al. | |
| 2013/0121714 | A1 | 5/2013 | Tanaka et al. | |
| 2013/0136468 | A1 | 5/2013 | Shimizu et al. | |
| 2013/0136477 | A1 | 5/2013 | Ogiyama et al. | |
| 2013/0142531 | A1 | 6/2013 | Sugimoto et al. | |
| 2013/0148993 | A1 | 6/2013 | Aoki et al. | |
| 2013/0164011 | A1 | 6/2013 | Nakamura et al. | |
| 2013/0177329 | A1 | 7/2013 | Tanaka et al. | |
| 2013/0182269 | A1 | 7/2013 | Tanaka | |
| 2013/0189002 | A1 | 7/2013 | Ichihashi et al. | |
| 2013/0195483 | A1 | 8/2013 | Shimizu et al. | |
| 2013/0216281 | A1 | 8/2013 | Suzuki et al. | |
| 2013/0223901 | A1 | 8/2013 | Minbe et al. | |
| 2013/0236201 | A1 | 9/2013 | Mizutani et al. | |
| 2013/0243482 | A1 | 9/2013 | Kato et al. | |
| 2013/0308968 | A1 | 11/2013 | Tanaka et al. | |
| 2014/0010562 | A1 | 1/2014 | Tanaka et al. | |
| 2014/0029988 | A1 | 1/2014 | Shimizu et al. | |
| 2014/0072340 | A1 | 3/2014 | Kato et al. | |
| 2014/0079418 | A1 | 3/2014 | Tanaka et al. | |
| 2014/0328603 | A1 * | 11/2014 | Mizutani | G03G 15/1605 399/21 |

FOREIGN PATENT DOCUMENTS

| | | |
|---|---|---|
| JP | 09-146381 | 6/1997 |
| JP | 2000-147923 | 5/2000 |
| JP | 2002-258686 | 9/2002 |
| JP | 2005-173002 | 6/2005 |
| JP | 2006-267486 | 10/2006 |
| JP | 2008-275844 | 11/2008 |
| JP | 2012-034496 | 2/2012 |
| JP | 2012-042827 | 3/2012 |
| JP | 2012-237974 | 12/2012 |
| JP | 2013-029809 | 2/2013 |

OTHER PUBLICATIONS

U.S. Appl. No. 14/209,330, filed Mar. 13, 2014.

Extended European Search Report issued on Dec. 4, 2014 in Patent Application No. 14165635.5.

* cited by examiner

IMAGE FORMING APPARATUS

CROSS-REFERENCE TO RELATED APPLICATIONS

The present application claims priority to and incorporates by reference the entire contents of Japanese Patent Application No. 2013-096272 filed in Japan on May 1, 2013, Japanese Patent Application No. 2013-107856 filed in Japan on May 22, 2013, Japanese Patent Application No. 2013-213603 filed in Japan on Oct. 11, 2013, and Japanese Patent Application No. 2013-267522 filed in Japan on Dec. 25, 2013.

BACKGROUND OF THE INVENTION

The present invention relates to an image forming apparatus and a transfer device that transfer toner images on an image carrier onto a recording sheet.

There is a need to provide an image forming apparatus capable of acquiring high-quality images while providing sufficient image density on both the recessed portions and the protruding portions on the surface of a recording sheet, without decreasing image density at the leading end of the recording sheet.

There is also a need to provide a transfer device capable of reducing poor transfer when a transfer bias power supply is used in which a direct current (DC) power supply and an alternating current (AC) power supply are electrically coupled to each other, and an image forming apparatus including such a transfer device.

SUMMARY OF THE INVENTION

It is an object of the present invention to at least partially solve the problems in the conventional technology.

According to an embodiment, there is provided an image forming apparatus that includes an image carrier that carries a toner image; a transfer member that forms a transfer nip between the transfer member and the image carrier; a power supply capable of outputting a superimposed transfer bias in which an alternating current component is superimposed onto a direct current component, the toner image on the image carrier being transferred onto a recording medium in the transfer nip by the superimposed transfer bias or a direct current bias consisting of the direct current component output by the power supply; and a controller that controls the power supply so that an output target value of the direct current component when the direct current component rises up is larger than an output target value of the direct current component when the toner image is transferred onto the recording medium.

According to another embodiment, there is provided an image forming apparatus that includes an image carrier that carries a toner image; a transfer member that forms a transfer nip between the transfer member and the image carrier; a counter member facing the transfer member with the image carrier interposed therebetween in the transfer nip; a power supply capable of outputting to the transfer member or the counter member a superimposed transfer bias in which an alternating current component is superimposed onto a direct current component, the toner image on the image carrier being transferred onto a recording medium in the transfer nip by the superimposed transfer bias or a direct current bias consisting of the direct current component output by the power supply; and a controller that controls the power supply so that an output of the direct current component to the transfer member or the counter member when the direct current component rises up is larger than an output of the direct current component to the transfer member or the counter member when the toner image is transferred onto the recording medium.

According to still another embodiment, there is provided an image forming apparatus that includes an image carrier that carries a toner image; a transfer member that forms a transfer nip between the transfer member and the image carrier; a power supply capable of outputting to the transfer member a superimposed transfer bias in which an alternating current component is superimposed onto a direct current component, the toner image on the image carrier being transferred onto a recording medium in the transfer nip by the superimposed transfer bias or a direct current bias consisting of the direct current component output by the power supply; and a controller that controls the power supply so that an output of the direct current component to the transfer member when the direct current component rises up is larger than an output of the direct current component to the transfer member when the toner image is transferred onto the recording medium.

According to still another embodiment, there is provided a transfer device that includes a nip forming member that comes into contact with an image carrier to form a transfer nip; a transfer bias power supply in which a direct-current power supply and an alternating-current power supply are electrically coupled to each other, the transfer bias power supply outputting a transfer bias, a toner image on the image carrier being transferred onto a recording medium sandwiched in the transfer nip by the transfer bias output by the transfer bias power supply; and a controller that controls the transfer bias power supply so that the direct current component of the transfer bias is switched to constant current control so as to reach a specified target current value determined in advance before the toner image on the image carrier is transferred onto the recording medium after the direct current component of the transfer bias rises up to a specified target voltage value determined in advance under constant voltage control.

According to still another embodiment, there is provided an image forming apparatus that includes the transfer device according to the above embodiment for transferring the image formed on a surface of the image carrier onto the recording medium.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
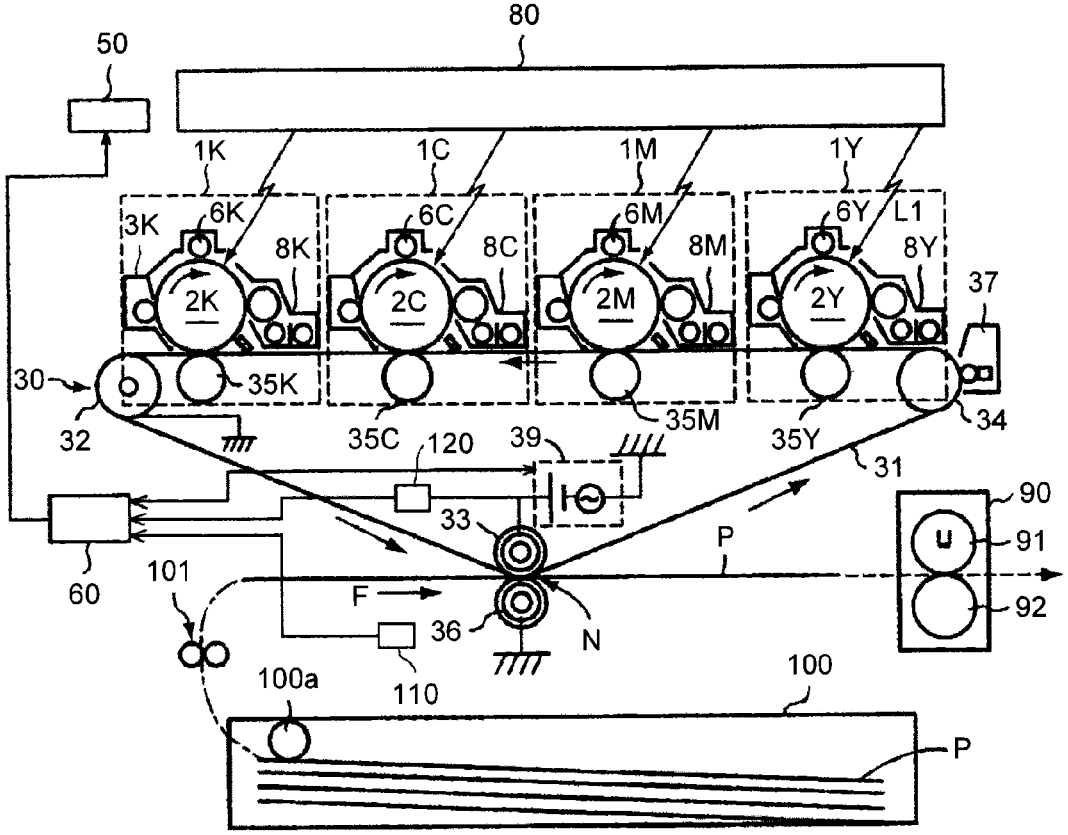
FIG. 1 is a schematic configuration diagram of a printer as an example of an image forming apparatus according to an embodiment of the present invention.

A conventional image forming apparatus is disclosed in Japanese Patent Application Laid-open No. 2006-267486, which transfers toner images on the surface of an image carrier onto a recording material sandwiched in a transfer nip in the apparatus. The image forming apparatus described in Japanese Patent Application Laid-open No. 2006-267486 forms toner images on the surface of a drum-shaped photosensitive element through the widely known electrophotography processing. An endless intermediate transfer belt serving as both an image carrier and an intermediate transferer is made to come into contact with the photosensitive element, thereby forming a primary transfer nip. In the primary transfer nip, toner images on the photosensitive element are primarily transferred onto the intermediate transfer belt. A secondary transfer roller as a transfer member is made to come into contact with the intermediate transfer belt, thereby forming a secondary transfer nip. A secondary transfer counter roller is disposed inside the loop of the intermediate transfer belt, which sandwiches the intermediate transfer belt between itself and the secondary transfer roller. The secondary transfer counter roller inside the loop is grounded, while a secondary transfer bias (a voltage) is applied from a power supply to the secondary transfer roller outside the loop. This forms a secondary transfer electric field between the secondary transfer counter roller and the secondary transfer roller, that is, in the secondary transfer nip. The secondary transfer electric field electrostatically moves toner images from the side of the secondary transfer counter roller to the side of the secondary transfer roller. The toner image on the intermediate transfer belt is secondarily transferred onto the recording sheet that has been fed into the secondary transfer nip at the time of synchronization with the toner images on the intermediate transfer belt through the action of the secondary transfer electric field or the nip pressure.

With this configuration, if a sheet having large asperity such as a sheet of Japanese paper is used as a recording sheet, the uneven density pattern according to the surface asperity of the recording sheet is likely to occur in the image. The uneven density pattern is generated because a sufficient amount of toner is not transferred onto recessed portions on the surface of the sheet, whereby the image density on the recessed portions is lower than the image density on the protruding portions. The image forming apparatus described in Japanese Patent Application Laid-open No. 2006-267486, therefore, applies a superimposed transfer bias in which a direct current (DC) voltage is superimposed onto the alternating current (AC) voltage as the secondary transfer bias rather than the transfer bias including the DC voltage only. In the image forming apparatus described in Japanese Patent Application Laid-open No. 2006-267486, the uneven density patterns occur fewer times by applying the above-described secondary transfer bias, than the uneven density patterns that applies the transfer bias including the DC voltage only.

Applying the superimposed transfer bias as the transfer bias needs a circuit for applying an alternating current component. If the circuit for applying an alternating current component is included in the power supply, the load of the circuit requires a longer time for rising-up of the direct current component. In particular, the circuit for applying an alternating current component with a capacitor significantly delays the rising-up. The delay of rising-up of the transfer bias causes the problem that insufficient density occurs at the leading end of the image.

In a transfer device included in the image forming apparatus disclosed in Japanese Patent Application Laid-open No. 2006-267486, a transfer bias in which the AC voltage is superimposed onto the DC voltage is applied by using a transfer bias power supply in which the DC power supply and the AC power supply are electrically coupled to each other. The transfer bias enables particles of the toner to reciprocate between the recessed portions on the surface of the recording sheet and the image carrier, and come into contact with the recessed portions on the surface of the recording sheet. This reduces poor transfer onto the recessed portions on the surface of the recording sheet.

If a superimposed transfer bias in which the DC voltage is superimposed onto the AC voltage by using the transfer bias power supply in which the DC power supply and the AC power supply are electrically coupled to each other, the direct current component of the transfer bias is output through a board of the AC power supply.

The inventor(s) have enthusiastically studied and found that if the transfer bias power supply in which the DC power supply and the AC power supply are electrically coupled to each other applies the transfer bias under constant current control, the following issue occurs.

The capacitor circuit in the board of the AC power supply requires a longer time for output response of the direct current component of the transfer bias than the example in which the DC voltage is output by using the DC power supply only. This often requires a longer time for rising-up of the bias until the bias reaches the target voltage value required for transferring images. As a result, the required transfer bias for transferring images at the leading end of the image cannot be ensured, which leads to insufficient transfer image density at the leading end of the image and thus causes poor transfer.

The applicant herein has developed a transfer device in which the direct current component of the transfer bias output by the transfer bias power supply in which the DC power supply and the AC power supply are electrically coupled to each other rises up under the constant voltage control and then the control is switched to constant current control before the toner image on the intermediate transfer belt is transferred onto the recording sheet.

The transfer device, in which the direct current component of the transfer bias output rises up by the transfer bias power supply under the constant voltage control, enables the direct current component to rise more steeply to the target voltage than the example in which the direct current component rises up under the constant current control. This decreases the rise time of the direct current component.

The transfer device outputs the direct current component under the constant voltage control only for a certain time period of rising-up to reach the maximum value of the direct current component of the transfer bias output by the transfer bias power supply.

This reduces insufficient density at the leading end of the image due to the shortage of the transfer bias resulting from a delay of rising-up of the bias before reaching the target voltage.

In the transfer device, when toner images on the intermediate transfer belt are transferred onto the recording sheet, the transfer bias is applied under the constant current control. This stabilizes the transfer electric field if the electric resistance of the intermediate transfer belt and/or the secondary transfer roller varies depending on the environmental conditions such as the temperature and the humidity, thereby achieving stable transferability.

The electric resistance of the intermediate transfer belt and/or the secondary transfer roller resulting from the environmental conditions such as the temperature and the humidity, however, changes the gradient of the rising-up of the direct current component. This may cause the voltage to fluctuate at the time point a given time has elapsed from the rising-up, that is, the target voltage cannot be always achieved.

The following describes an embodiment of the present invention.

First Embodiment

A first embodiment according to the present invention will now be described in detail with reference to the accompanying drawings.

FIG. 1 is a schematic configuration diagram of an electrophotographic color printer (hereinafter, simply referred to as a "printer") as an example of an image forming apparatus according to an embodiment of the present invention.

As illustrated in FIG. 1, the printer according to the embodiment includes four image forming units 1Y, 1M, 1C, and 1K for forming toner images of yellow, magenta, cyan, and black (hereinafter, referred to as Y, M, C, and K, respectively) colors, a transfer unit 30 serving as a transfer device, an optical writing unit 80, a fixing device 90, a paper cassette 100, a pair of registration rollers 101, and a control unit 60.

Figure 2:
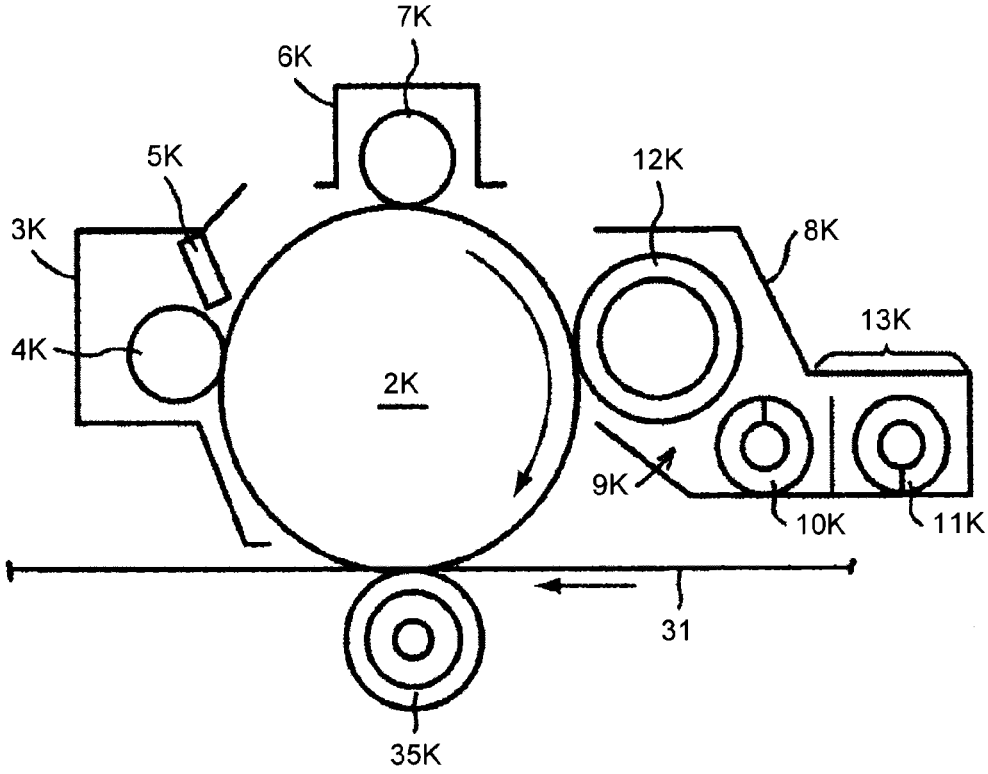
FIG. 2 is an enlarged view illustrating a schematic configuration of an image forming unit for a black color in the printer illustrated in FIG. 1 according to the embodiment.

The four image forming units 1Y, 1M, 1C, and 1K use, as image forming material, Y, M, C, and K toners, respectively, which are different in color from one another. Except for the difference in color of the toners, the image forming units 1Y, 1M, 1C, and 1K are similar in structure, and are replaced with new image forming units when the life thereof expires. For example, as illustrated in FIG. 2, the image forming unit 1K for forming a K toner image includes a drum-shaped photosensitive element 2K serving as a image carrier, a drum cleaning device 3K, a neutralization device (not illustrated), a charging device 6K, and a developing device 8K. The above-described components are held in a common holder to be detachably attached to a body of the printer as a unit. It is thereby possible to replace the components at the same time.

The photosensitive element 2K includes a drum-shaped base having the outer circumferential surface provided with an organic photosensitive layer in a drum shape, and is driven to rotate clockwise in the drawing by a driving unit (not illustrated). In the charging device 6K, a charging roller 7K applied with a charging bias is brought into contact with or proximity to the photosensitive element 2K to cause discharge between the charging roller 7K and the photosensitive element 2K. Thereby, the outer circumferential surface of the photosensitive element 2K is uniformly charged. In the printer of the embodiment, the surface of the photosensitive element 2K is uniformly charged to the same negative polarity as a normal charge polarity of toner. More specifically, the surface of the photosensitive element 2K is uniformly charged to a value of approximately −650 V. As the charging bias, an alternating current (AC) voltage superimposed on a direct current (DC) voltage (or controlled as a DC current) is employed. The charging roller 7K includes a metal core having an outer circumferential surface covered with a conductive elastic layer made of a conductive elastic material. The method of bringing a charging member, such as the charging roller, into contact with or proximity to the photosensitive element 2K may be replaced with a method using an electric charger.

The surface of the photosensitive element 2K, which has been uniformly charged by the charging device 6K, is subjected to optical scanning with laser light emitted from the optical writing unit 80, and carries an electrostatic latent image for the K color. The potential of the electrostatic latent image for the K color is approximately −100 V. The electrostatic latent image for the K color is developed into a K toner image by the developing device 8K (not illustrated) using K toner. Then, the K toner image is primarily transferred onto a later-described intermediate transfer belt 31 serving as an intermediate transfer unit and a belt-shaped carrier.

The drum cleaning device 3K removes post-transfer residual toner adhering to the surface of the photosensitive element 2K after a primary transfer process, i.e., after the passage through a later-described primary transfer nip. The drum cleaning device 3K includes a cleaning brush roller 4K driven to rotate, and a cantilever-supported cleaning blade 5K having a free end brought into contact with the photosensitive element 2K. The drum cleaning device 3K scrapes the post-transfer residual toner from the surface of the photosensitive element 2K by using the rotating cleaning brush roller 4K. The cleaning blade scrapes the post-transfer residual toner off the surface of the photosensitive element 2K. The cleaning blade is brought into contact with the photosensitive element 2K in a counter direction in which the cantilever-supported end of the cleaning blade is directed further downstream in the photosensitive element rotation direction than the free end of the cleaning blade.

The above-described neutralization device neutralizes residual charge remaining on the photosensitive element 2K after the cleaning by the drum cleaning device 3K. With the neutralizing, the surface of the photosensitive element 2K is initialized to prepare for the next image forming operation.

The developing device 8K includes a developing unit 9K housing a developing roller 12K, and a developer conveying unit 13K for stirring and conveying K developer (not illustrated). The developer conveying unit 13K includes a first conveying chamber housing a first screw member 10K, and a second conveying chamber housing a second screw member 11K. Each of the first screw member 10K and the second screw member 11K includes a rotary shaft member having both end portions in an axial direction thereof rotatably supported by respective shaft bearings, and a helical blade helically protruding from the outer circumferential surface of the rotary shaft.

The first conveying chamber housing the first screw member 10K and the second conveying chamber housing the second screw member 11K are separated by a dividing wall. The dividing wall has both end portions in the axial direction of the first screw member 10K and the second screw member 11K formed with communication ports through which the two conveying chambers communicate with each other. The first screw member 10K is driven to rotate to stir, in a rotation direction thereof, the not-illustrated K developer held inside the helical blade in accordance with the rotation of the first screw member 10K, and conveys the K developer from the far side toward the near side in a direction perpendicular to the plane of the drawing. The first screw member 10K and the later-described developing roller 12K are arranged parallel to each other to face each other. In this case, therefore, a conveyance direction of the K developer extends along an axial direction of the developing roller 12K. The first screw member 10K supplies the K developer to the outer circumferential surface of the developing roller 12K along the axial direction of the developing roller 12K.

The K developer conveyed to the proximity of an end portion of the first screw member 10K on the near side in the drawing enters the second conveying chamber through the communication port provided near the end portion of the dividing wall on the near side in the drawing. Thereafter, the K developer is held inside the helical blade of the second screw member 11K. Then, as the second screw member 11K is driven to rotate, the K developer is stirred in a rotation direction of the second screw member 11K and conveyed from the near side toward the far side in the drawing.

In the second conveying chamber, a toner density detection sensor is mounted on a lower wall of a casing of the developing device 8K to detect the K toner density in the K developer in the second conveying chamber. A magnetic permeability sensor is employed as the K toner density detection sensor. The magnetic permeability of the K developer containing the K toner and magnetic carriers is correlated with the K toner density. Therefore, the magnetic permeability sensor detects the K toner density.

The printer of the embodiment includes Y, M, C, and K toner replenishment units (not illustrated) for separately replenishing the Y, M, C, and K toner into the respective second conveying chambers of the developing devices for the Y, M, C, and K colors. The control unit 60 of the printer stores, in a random access memory (RAM), a value $Vt_{ref}$ for each of the Y, M, C, and K colors, which is the target value of the voltage output from each of the Y, M, C, and K toner density detection sensors. If the difference between the value of the voltage output from one of the Y, M, C, and K toner density detection sensors and the target value $Vt_{ref}$ for the corresponding one of the Y, M, C, and K colors exceeds a predetermined value, the corresponding one of the Y, M, C, and K toner replenishment units is driven for a length of time corresponding to that difference. Thereby, the second conveying chamber of the corresponding one of the developing devices for the Y, M, C, and K colors is replenished with the corresponding one of the Y, M, C, and K toners.

The developing roller 12K housed in the developing device is disposed opposite the first screw member 10K, and is also disposed opposite the photosensitive element 2K through an opening disposed in the casing. The developing roller 12K includes a cylindrical developing sleeve constructed of a non-magnetic pipe and driven to rotate, and a magnet roller fixedly provided inside the developing sleeve so as not to be rotated together with the developing sleeve. With magnetic force generated by the magnet roller, the developing roller 12K carries, on the outer circumferential surface of the developing sleeve, the K developer supplied by the first screw member 10K, and conveys the K developer to a development area disposed opposite the photosensitive element 2K in accordance with the rotation of the developing sleeve.

The developing sleeve is applied with a development bias, which is the same in polarity as the K toner and has an electric potential higher than the electric potential of the electrostatic latent image on the photosensitive element 2K and lower than the electric potential of the uniformly charged surface of the photosensitive element 2K. Between the developing sleeve and the electrostatic latent image on the photosensitive element 2K, therefore, a development potential arises, which electrostatically moves the K toner on the developing sleeve toward the electrostatic latent image. Meanwhile, between the developing sleeve and the background area on the photosensitive element 2K, a non-development potential arises, which moves the K toner on the developing sleeve toward the surface of the developing sleeve. With the action of the development potential and the non-development potential, the K toner on the developing sleeve is selectively transferred to the electrostatic latent image on the photosensitive element 2K to develop the electrostatic latent image into the K toner image.

Similar to the image forming unit 1K for the K color, toner images of Y, M, and C are formed on the photosensitive elements 2Y, 2M, and 2C of the image forming units 1Y, 1M, and 1C for the Y, M, and C colors, respectively as illustrated in FIG. 1.

Above the image forming units 1Y, 1M, 1C, and 1K, the optical writing unit 80 serving as a latent image forming unit is arranged. The optical writing unit 80 optically scans the photosensitive elements 2Y, 2M, 2C, and 2K with a light beam projected from a light source such as a laser diode based on image information received from an external device such as a personal computer (PC). Accordingly, the electrostatic latent images of Y, M, C, and K are formed on the photosensitive elements 2Y, 2M, 2C, and 2K, respectively. Specifically, the electrostatic latent image has electric potential on the portion irradiated with the laser light out of the uniformly charged entire surface of the photosensitive element 2Y less than the electric potential of the other area, that is, the background portion. The optical writing unit 80 irradiates the photosensitive element with the laser light L emitted from a plurality of light sources and deflected in a main-scanning direction by the polygon mirror rotated by a polygon motor (not illustrated) through a plurality of optical lenses or mirrors. The optical writing unit 80 may employ a light source using a light-emitting diode (LED) array including a plurality of LEDs that project light.

Below the image forming units 1Y, 1M, 1C, and 1K, the transfer unit 30 is disposed as a transfer device that stretches and moves the endless intermediate transfer belt 31 in a counterclockwise direction in the drawing in an endless manner while stretching the intermediate transfer belt 31. The transfer unit 30 includes, in addition to the intermediate transfer belt 31 serving as an image carrier, a driving roller 32, a repulsive roller 33, a cleaning backup roller 34, four primary transfer rollers 35Y, 35M, 35C, and 35K serving as primary transfer members, a secondary transfer roller 36 serving as a transfer member, and a belt cleaning device 37.

The intermediate transfer belt 31 is stretched over the driving roller 32, the repulsive roller 33, the cleaning backup roller 34, and the four primary transfer rollers 35Y, 35M, 35C, and 35K disposed inside the loop. The driving roller 32 is rotated by a driving unit (not illustrated) in the counterclockwise direction in FIG. 1, and the rotation of the driving roller 32 enables the intermediate transfer belt 31 to rotate in the same direction.

The intermediate transfer belt 31 is moved sandwiched between the four primary transfer rollers 35Y, 35M, 35C, and 35K and the photosensitive elements 2Y, 2M, 2C, and 2K, respectively. Thereby, primary transfer nips for the Y, M, C, and K colors are formed in which the outer circumferential surface of the intermediate transfer belt 31 comes into contact with the photosensitive elements 2Y, 2M, 2C, and 2K. The primary transfer rollers 35Y, 35M, 35C, and 35K are applied with a primary transfer bias by not-illustrated primary transfer bias power supplies, respectively. Thereby, transfer electric fields are generated between the Y, M, C, and K toner images on the photosensitive elements 2Y, 2M, 2C, and 2K and the primary transfer rollers 35Y, 35M, 35C, and 35K. In accordance with the rotation of the photosensitive element 2Y for the Y color, the Y toner image formed on the surface of the photosensitive element 2Y enters the primary transfer nip for the Y color. Then, with the action of the transfer electric field and nip pressure, the Y toner image is primarily transferred from the photosensitive element 2Y onto the intermediate transfer belt 31. Thereafter, the intermediate transfer belt 31 having the Y toner image thus primarily transferred thereto sequentially passes the respective primary transfer nips for the M, C, and K colors. Then, the M, C, and K toner images on the photosensitive elements 2M, 2C, and 2K are sequentially primarily transferred onto the Y toner image in a superimposed manner. With this primary transfer of the toner images in the superimposed manner, a four-color superimposed toner image is formed on the intermediate transfer belt 31.

Each of the primary transfer rollers 35Y, 35M, 35C, and 35K includes an elastic roller structured of a metal core with a conductive sponge layer fixed on the outer circumferential surface thereof. Each of the primary transfer rollers 35Y, 35M, 35C, and 35K is disposed on the position shifted from the axial center of each of the photosensitive elements 2Y, 2M, 2C, and 2K by approximately 2.5 mm toward the downstream in the moving direction of the belt. The thus-structured primary transfer rollers 35Y, 35M, 35C, and 35K are applied with the primary transfer bias under constant current control. The primary transfer rollers 35Y, 35M, 35C, and 35K may be replaced with transfer chargers or transfer brushes as transfer members.

The secondary transfer roller 36 of the transfer unit 30 is disposed outside the loop of the intermediate transfer belt 31. The intermediate transfer belt 31 is sandwiched between the secondary transfer roller 36 and the repulsive roller 33 disposed inside the loop of the intermediate transfer belt 31. Thereby, a secondary transfer nip N is formed, in which the outer circumferential surface of the intermediate transfer belt 31 and the secondary transfer roller 36 come into contact with each other. The secondary transfer roller 36 is grounded, and the repulsive roller 33 is applied with a secondary transfer bias as a voltage by the power supply serving as a secondary transfer bias power supply in the example illustrated in FIGS. 1 and 2. Between the repulsive roller 33 and the secondary transfer roller 36, therefore, a secondary transfer electric field is formed that electrostatically moves toner of negative polarity from the side of the repulsive roller 33 toward the side of the secondary transfer roller 36.

Below the transfer unit 30, the paper cassette 100 is provided that stores therein a sheet bundle including a plurality of stacked recording sheets P as recording media. In the paper cassette 100, the uppermost recording sheet P of the sheet bundle is made to come into contact with a paper feeding roller 100*a*. The paper feeding roller 100*a* is driven to rotate at a predetermined time to send the recording sheet P into a paper feeding path. The pair of registration rollers 101 is provided near a lower end of the sheet feeding path. The pair of registration rollers 101 sandwiches, between both rollers, the recording sheet P that is fed from the paper cassette 100. Immediately thereafter, the rotation of the rollers is stopped.

Then, the rollers are again driven to rotate at the time for causing the sandwiched recording sheet P to synchronize with the four-color superimposed toner image on the intermediate transfer belt 31 in the secondary transfer nip N. Thereby, the recording sheet P is sent toward the secondary transfer nip. The toner images included in the four-color superimposed toner image on the intermediate transfer belt 31 brought into close contact with the recording sheet P in the secondary transfer nip N are secondarily transferred onto the recording sheet P at the same time by the action of the secondary transfer electric field and nip pressure, and are formed into a full-color toner image with white color of the recording sheet P. The recording sheet P having the full-color toner image thus formed on a surface thereof passes the secondary transfer nip N, and separates from the secondary transfer roller 36 and the intermediate transfer belt 31 owing to the curvatures of the secondary transfer roller 36 and the intermediate transfer belt 31.

The repulsive roller 33 includes a metal core and a conductive NBR rubber layer provided on the surface of the metal core. The secondary transfer roller 36 also includes a metal core and a conductive NBR rubber layer provided on the surface of the metal core.

The power supply 39 outputs a voltage for transferring toner images on the intermediate transfer belt 31 onto the recording sheet P sandwiched in the secondary transfer nip N (hereinafter, referred to as a "secondary transfer bias"). The power supply 39 includes the DC power supply and the AC power supply, and can output a superimposed transfer bias in which an alternating current voltage is superimposed on a direct current voltage as the secondary transfer bias. In the present embodiment, as illustrated in FIG. 1, the secondary transfer bias is applied to the repulsive roller 33 and the secondary transfer roller 36 is grounded.

Figure 3:
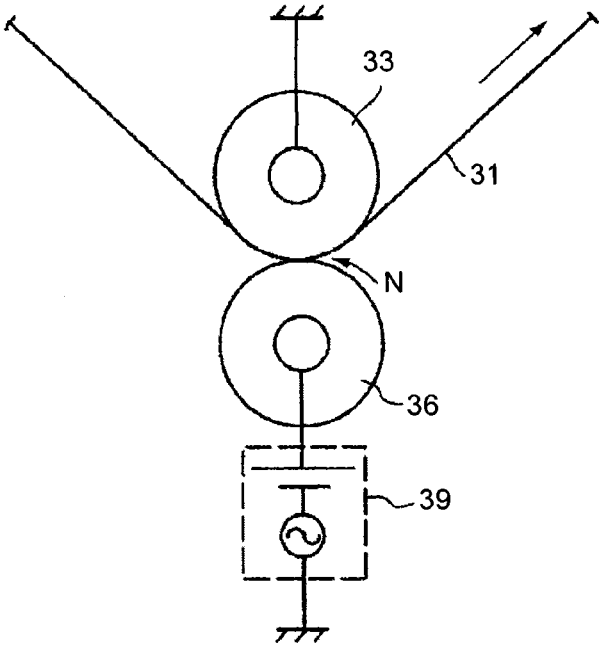
FIG. 3 is an enlarged view illustrating another form of a power supply and voltage supply for secondary transfer in the image forming apparatus according to the embodiment.
Figure 4:
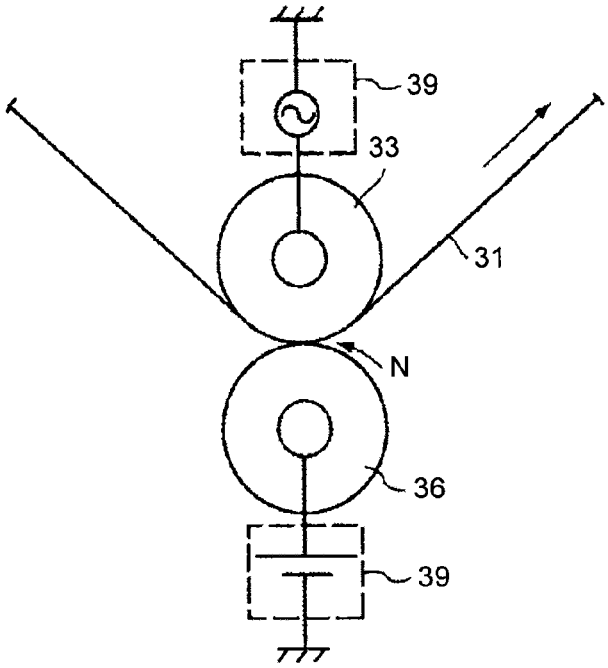
FIG. 4 is an enlarged view illustrating still another form of a power supply and voltage supply for secondary transfer in the image forming apparatus according to the embodiment.
Figure 5:
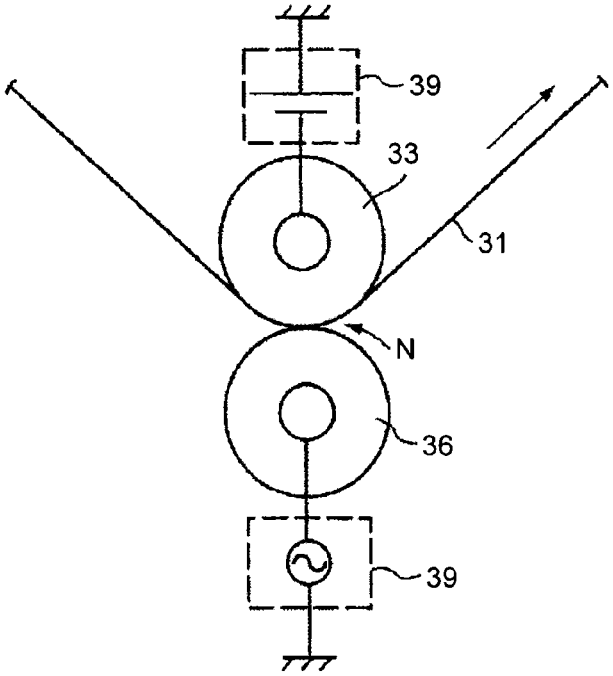
FIG. 5 is an enlarged view illustrating still another form of a power supply and voltage supply for secondary transfer in the image forming apparatus according to the embodiment.

The form of supplying the secondary transfer bias illustrated in FIG. 1 is provided merely for exemplary purpose and not limiting. As illustrated in FIG. 3, the secondary transfer bias may be supplied by applying the superimposed transfer bias from the power supply 39 to the secondary transfer roller 36 and grounding the repulsive roller 33. In this example, the polarity of the DC voltage is different from the example illustrated in FIG. 1. Specifically, as illustrated in FIG. 1, if the superimposed transfer bias is applied to the repulsive roller 33 while the negative polarity toner is used and the secondary transfer roller 36 is grounded, the direct current voltage of the same negative polarity as the toner is used so that the time-averaged potential of the superimposed transfer bias is the same negative polarity as the toner.

By contrast, as illustrated in FIG. 3, when the repulsive roller 33 is grounded and the secondary transfer roller 36 is applied with the superimposed transfer bias, the direct current voltage of positive polarity, opposite the polarity of toner, is used so that the time-averaged potential of the superimposed transfer bias is positive polarity opposite the polarity of toner.

Instead of supplying the superimposed transfer bias as the secondary transfer bias to either the repulsive roller 33 or the secondary transfer roller 36, the direct current voltage may be supplied to one of the rollers and the alternating current voltage from the power supply 39 may be supplied to the other roller.

Figure 6:
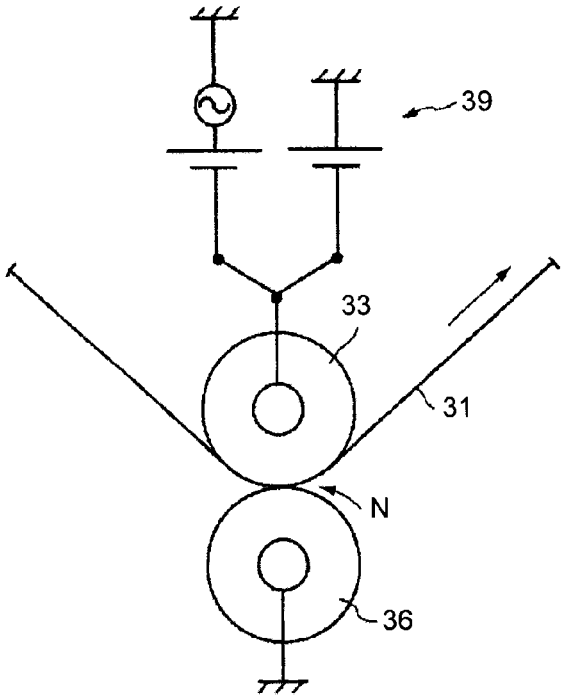
FIG. 6 is an enlarged view illustrating still another form of a power supply and voltage supply for secondary transfer in the image forming apparatus according to the embodiment.
Figure 7:
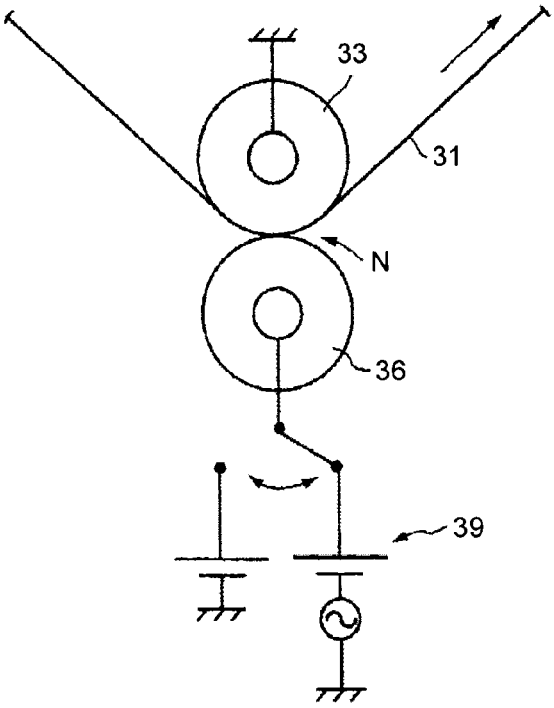
FIG. 7 is an enlarged view illustrating still another form of a power supply and voltage supply for secondary transfer in the image forming apparatus according to the embodiment.

The forms of supplying the secondary transfer bias are provided merely for exemplary purpose and not limiting. As illustrated in FIGS. 6 and 7, "the DC voltage+the AC voltage" and "the DC voltage" are supplied to one of the rollers in a switching manner. In the form illustrated in FIG. 6, the repulsive roller 33 is applied with "the DC voltage+the AC voltage" and "the DC voltage" from the power supply 39 in a switching manner. In the form illustrated in FIG. 7, the secondary transfer roller 36 is applied with "the DC voltage+the AC voltage" and "the DC voltage" from the power supply 39 in a switching manner.

Figure 8:
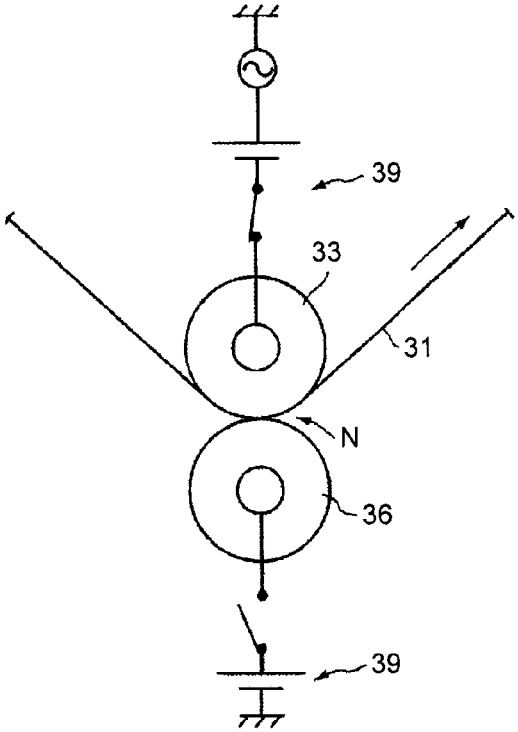
FIG. 8 is an enlarged view illustrating still another form of a power supply and voltage supply for secondary transfer in the image forming apparatus according to the embodiment.
Figure 9:
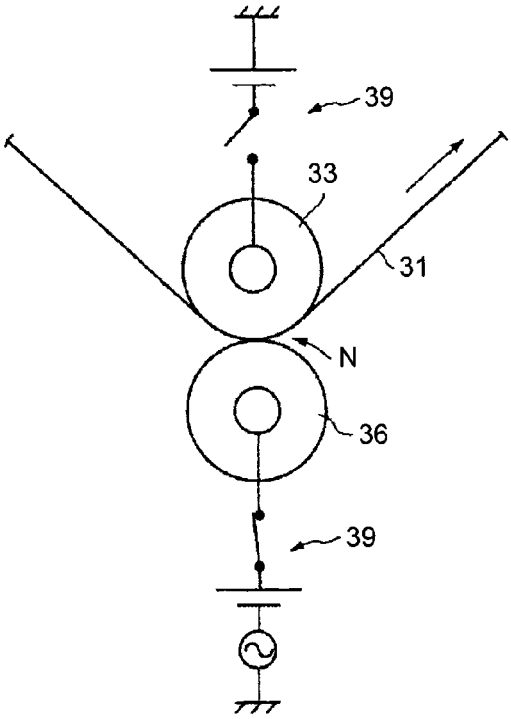
FIG. 9 is an enlarged view illustrating still another form of a power supply and voltage supply for secondary transfer in the image forming apparatus according to the embodiment.

When switching the secondary transfer bias between "the DC voltage+the AC voltage" and "the DC voltage", as illustrated in FIGS. 8 and 9, the secondary transfer bias, "the DC voltage+the AC voltage" can be supplied to one of the rollers and "the DC voltage" can be supplied to the other roller, for appropriately switching the supply voltage. In the form illustrated in FIG. 8, the repulsive roller 33 can be applied with "the DC voltage+the AC voltage" and the secondary transfer roller 36 can be applied with the DC voltage. In the form illustrated in FIG. 9, the repulsive roller 33 can be applied with "the DC voltage" and the secondary transfer roller 36 can be applied with "the DC voltage+the AC voltage".

As described above, the secondary transfer bias can be supplied to the secondary transfer nip N in a variety of forms. The power supply can be appropriately selected according to the form of supply out of various types of power supplies such as: a power supply for supplying "the DC voltage+the AC voltage" such as the power supply 39; a power supply for supplying "the DC voltage" and "the AC voltage" individually; a power supply for supplying "the DC voltage+the AC voltage" and "the DC voltage" using a single power supply in a switching manner. The power supply 39 used for the secondary transfer bias includes a first mode and a second mode in a switching manner. In the first mode, the power supply includes the DC voltage only, and in the second mode, a superimposed voltage is output in which the AC voltage is superimposed onto the DC voltage. In the forms illustrated in FIGS. 1, 3, 4, and 5, the mode can be switched by turning on or off the AC voltage output. In the forms illustrated in FIGS. 6 to 9, the mode can be switched in a selective manner out of two power supplies by using a switching unit such as a relay.

When using a normal sheet of paper such as the one having relatively smooth surface, rather than using a sheet having large asperity such as a sheet with a rough surface as the recording sheet P, uneven density pattern according to the surface condition of the sheet does not appear. Thus, the first mode is selected to supply the secondary transfer bias including the DC voltage only. By contrast, when using a sheet having large asperity such as a sheet with a rough surface, the second mode is selected to supply the superimposed secondary transfer bias in which the AC voltage is superimposed onto the DC voltage. That is, the mode of the secondary transfer bias may be switched between the first mode and the second mode according to the type of the recording sheet P in use, i.e., according to the degree of asperity on the surface of the recording sheet P.

After the intermediate transfer belt 31 passes through the secondary transfer nip N, residual toner not having been transferred onto the recording sheet P remains on the intermediate transfer belt 31. The residual toner is removed from the outer circumferential surface of the intermediate transfer belt 31 by the belt cleaning device 37 that contacts the outer circumferential surface of the surface of the intermediate transfer belt 31. The cleaning backup roller 34 disposed inside the loop formed by the intermediate transfer belt 31 supports the cleaning operation by the belt cleaning device 37 from inside the loop of the intermediate transfer belt 31 so that the residual toner on the intermediate transfer belt 31 is removed reliably.

On the right side in FIG. 1, which is nearer to the downstream side than the secondary transfer nip N in the recording sheet conveying direction, the fixing device 90 is disposed. The fixing device 90 includes a fixing roller 91 and a pressing roller 92. The fixing roller 91 includes a heat source such as a halogen lamp inside thereof. While rotating, the pressing roller 92 pressingly contacts the fixing roller 91 with a certain value of pressure, thereby forming a heated area called a fixing nip therebetween. The recording sheet P bearing an unfixed toner image on the surface thereof is conveyed to the fixing device 90 and interposed between the fixing roller 91 and the pressing roller 92 in the fixing device 90 with the carrying surface of the unfixed toner image closely contacted with the fixing roller 91. Under heat and pressure in the fixing nip, the toner adhering to the toner image is softened and a full-color image is fixed to the recording sheet P. Subsequently, the recording sheet P is ejected outside the image forming apparatus from the fixing device 90 along a sheet passage after fixing.

In the printer according to the present embodiment, three modes are set in the control unit 60: the standard mode, the high-quality mode, and the high-speed mode. The process linear speed (the linear speed of the photosensitive element or the intermediate transfer belt) in the standard mode is set to approximately 280 mm/s. In the high-quality mode, in which the image quality is given priority over the printing speed, the process linear speed is set to a value smaller than the value in the standard mode. In the high-speed mode, in which the printing speed is given priority over the image quality, the process linear speed is set to a value larger than the value in the standard mode. The standard mode, the high-quality mode, the high-speed mode are switched from each other through key operations by a user on an operation panel 50 (refer to FIG. 10) provided on the printer, or the printer property menu displayed on the personal computer operated by a user and coupled to the printer.

In the printer according to the present embodiment, to form a monochrome image, a not-illustrated movable support plate supporting the primary transfer rollers 35Y, 35M, and 35C for the Y, M, and C colors in the transfer unit 30 is moved to separate the primary transfer rollers 35Y, 35M, and 35C away from the photosensitive elements 2Y, 2M, and 2C, respectively. Thereby, the outer circumferential surface of the intermediate transfer belt 31 is separated from the photosensitive elements 2Y, 2M, and 2C, and the intermediate transfer belt 31 is brought into contact only with the photosensitive element 2K for the K color. In this state, only the image forming unit 1K for the K color is driven among the four image forming units 1Y, 1M, 1C, and 1K. Thereby, the K toner image is formed on the photosensitive element 2K.

In the printer according to the present embodiment, the direct current component of the secondary transfer bias has an equal value to the time-averaged value of voltage (Vave), that is, the time-averaged voltage value (the time-averaged value) Vave serving as the value of the direct current component. The time-averaged value of voltage Vave is obtained by dividing the integrated value for one cycle of a voltage waveform by the length of the single period.

In the printer according to the present embodiment, the secondary transfer bias is applied to the repulsive roller 33 and the secondary transfer roller 36 is grounded. If the polarity of the secondary transfer bias is the same negative polarity as the polarity of toner, the toner of negative polarity can be electrostatically forced from the side of the repulsive roller 33 to the side of the secondary transfer roller 36 in the secondary transfer nip N. This moves the toner on the intermediate transfer belt 31 onto the recording sheet P. By contrast, if the polarity of the secondary transfer bias is opposite to the polarity of toner, that is, the polarity of the secondary transfer bias is positive, the toner of negative polarity is drawn electrostatically to the side of the repulsive roller 33 from the side of the secondary transfer roller 36. This returns the toner that has been moved to the recording sheet P to the side of the intermediate transfer belt 31.

If a sheet having large asperity such as a sheet of Japanese paper is used as the recording sheet P, the uneven density pattern according to the surface asperity of the recording sheet is likely to occur in the image. To address this, with the technology disclosed in Japanese Patent Application Laid-open No. 2006-267486, the superimposed transfer bias in which the DC voltage is superimposed onto the AC voltage is applied as the secondary transfer bias instead of the secondary transfer bias including the DC voltage only.

The inventor(s) of the present invention, however, found that such a configuration may decrease the image density at the leading end of the image (the leading end of the sheet) through performing some tests. The inventor(s) have enthusiastically studied about the cause of insufficient density at the leading end of the image (the leading end of the sheet) and found the following.

To transfer the toner onto the asperity (the recessed portions and the protruding portions) on the sheet through reciprocating motion of the toner, the AC voltage or the AC current needs to be applied. To achieve this, a bypass capacitor needs to be disposed in a high-pressure circuit, which serves as a passage of the voltage or the current of the alternating current component. For that reason, the capacity for charging is significantly large compared to an image forming apparatus employing the direct current component only. As a result, with the conventional transfer bias, the time required for rising-up of the direct current component to the value required for the transfer in the transfer nip N is significantly longer.

In the embodiment according to the present invention, therefore, the output at the time of rising-up of the direct current component in the transfer bias is determined to be larger than the output at the time of transferring the image section (the output at the time of transferring the image section onto the recording material). This reduces the rise time of the direct current component (i.e., the direct current component quickly rises up to the value required for the image transfer), thereby preventing the insufficient density at the leading end of the image (the leading end of the sheet).

The following describes the characteristic configuration of the printer according to the present embodiment.

Figure 10:
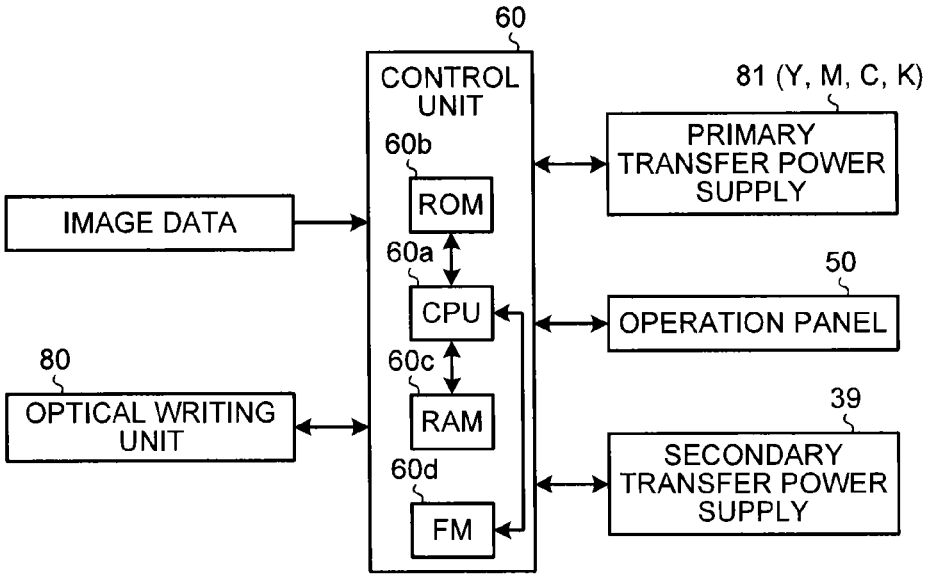
FIG. 10 is a block diagram illustrating a part of the control system of the printer illustrated in FIG. 1 according to the embodiment.

FIG. 10 is a block diagram illustrating a part of the control system of the printer illustrated in FIG. 1. In FIG. 10, the control unit 60 is included in the transfer bias output unit and includes a central processing unit (CPU) 60*a* serving as a calculating unit, a random access memory (RAM) 60*c* serving as a non-volatile memory, a read only memory (ROM) 60*b* serving as a temporary recording unit, and a flash memory 60*d*. Although various types of components, devices, and sensors are electrically coupled in a communicable manner to the control unit 60 that totally controls the printer, only the characteristic components of the printer according to the present embodiment are illustrated in FIG. 10.

A primary transfer power supply 81 (Y, M, C, and K) outputs the primary transfer bias to be applied to the primary transfer rollers 35Y, 35M, 35C, and 35K. The power supply 39 for the secondary transfer outputs the secondary transfer bias to be supplied to the secondary transfer nip N. In the form illustrated in FIG. 1, the secondary transfer bias to be applied to the repulsive roller 33 is output. The power supply 39 and the control unit 60 are included in the transfer bias output unit. The operation panel 50 includes a not-illustrated touch panel and a plurality of key buttons and is capable of displaying images on the touch panel. The operation panel 50 has functions to receive input operations by an operator through the touch panel and the key buttons and transmit the input information to the control unit 60. The operation panel 50 can also display images on the touch panel according to the control signals transmitted from the control unit 60.

As described above, in the embodiment according to the present invention, the output target value at the boost rise time of the direct current component in the transfer bias is determined larger than the output target value at the time of transferring the image section. In other words, the output value of the direct current component to the secondary transfer roller 36 at the rising-up of the direct current component is determined to be larger than the output value of the direct current component to the secondary transfer roller 36 at the transfer of the toner images onto the recording sheet P.

Figure 11:
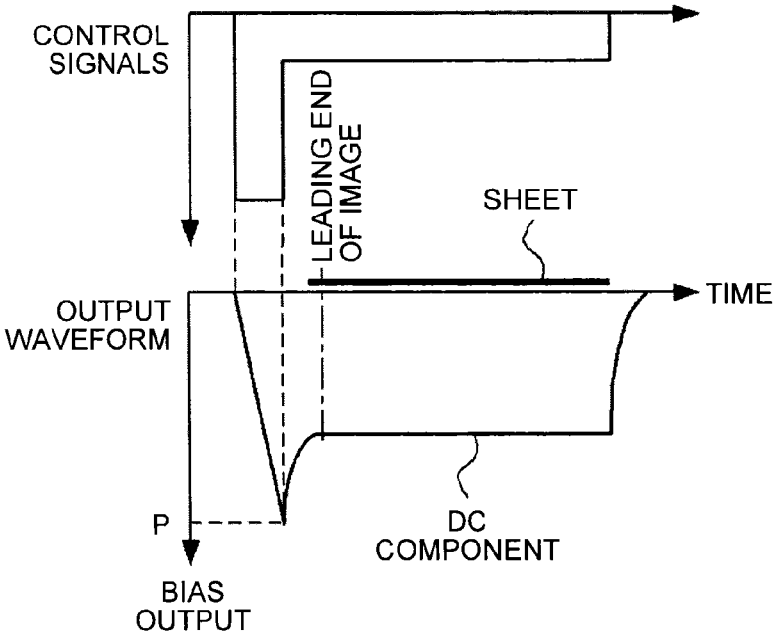
FIG. 11 is a schematic diagram illustrating control signals and an output waveform for explaining rising-up of a direct current component according to the embodiment.

The rising-up of the direct current component of the bias will now be described. In FIG. 11, the upper graph illustrates the waveform of the control signals, and the lower graph illustrates the waveform of the current or the voltage output to the repulsive roller 33. The control signals correspond to the output target value of the direct current component of the bias. As illustrated in the upper graph in FIG. 11, the control signals cause the direct current component to rise up with the large output target value (the current or the voltage) before the transfer material (the recording sheet) enters the transfer nip. Subsequently, the control signals lower the direct current component at the time of transferring images onto the recording material (the leading end of the image) and later to the output target value (the current or the voltage) appropriate for image transfer. As a result, as illustrated in the waveform of the lower diagram in FIG. 11, before the transfer material (the recording sheet) enters the transfer nip, the direct current component of the current or the voltage output to the repulsive roller 33 rises up with a large output value (the current or the voltage) to form the peak value P. After that, the direct current component lowers to the output value (the current or the voltage) appropriate for image transfer and smaller than the peak value P at the rise time to transfer images onto the recording material (at the leading end of the image).

The following describes the tests performed by the inventor(s) of the present invention and the characteristic configuration of the printer according to the embodiment.

The inventor(s) of the present invention prepared a printing testing machine including the same components as the printer according to the embodiment. The inventor(s) performed various types of printing tests by using the printing testing machine with the following settings for the components.

the process linear speed serving as the linear speed of the photosensitive elements or the intermediate transfer belt 31: 176 mm/s the frequency f of the alternating current component of the secondary transfer bias: 500 Hz the transfer current of the secondary transfer bias at the time of transferring the image section: −40 μA the recording sheet P: Leathac 66 (a trade name) 175 kg paper weights (ream weight of duodecimos) manufactured by TOKUSHU PAPER TRADING CO., LTD Leathac 66 has larger asperity on the surface of the sheet than "Sazanami" (a trade name). The depth of the recessed portions on the surface of the sheet is approximately 100 μm in maximum.

The tests were performed in two different environments: at a temperature of 23° C. and a humidity of 50%; at a temperature of 10° C. and a humidity of 15%. The power supplies serving as a bias applying unit has the configuration illustrated in FIG. 12.

The inventor(s) generates a solid image in blue by superimposing a solid image in magenta and a solid image in cyan to determine whether sufficient image density can be acquired at the leading end of the recording sheet.

Figure 12:
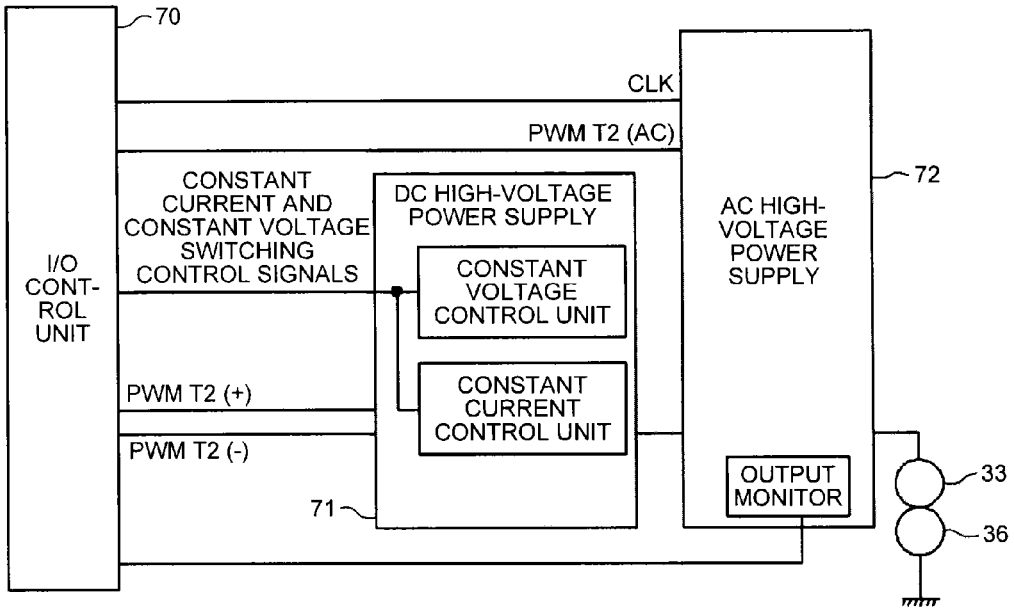
FIG. 12 is a block diagram illustrating the configuration of power supplies of a printing testing machine according to the embodiment.

The configuration of the power supplies illustrated in FIG. 12 includes a DC high-voltage power supply 71 and an AC high-voltage power supply 72, which can apply the DC bias and the superimposed transfer bias (the DC bias onto which the AC bias is superimposed). When applying the DC bias, the DC high-voltage power supply 71 performs high-pressure output of 2 kV (50 μA) according to the signals of pulse width modulation (PWM) T2(+). When applying the superimposed transfer bias, the DC high-voltage power supply 71 and the AC high-voltage power supply 72 perform high-pressure AC-superimposed output of 100 μA (−10 kV)+10 kVpp (1 mA) according to the signals of PWM T2(−) and PWM T2(AC). In the two types of output above, constant current and constant voltage switching control signals can switch the output between constant voltage output and constant current output. Specifically, the control signals from The I/O control unit 70 switch the output to flow the current from the repulsive roller 33 through the secondary transfer roller 36 to the ground to let the sheet to draw the toner.

The control signals illustrated in FIG. 11 and FIGS. 13 to 16 described later correspond to the output target value of the DC component of the bias, that is, the duty ratio of PWM T2(−) signals serving as the pulse width modulation signals output by the I/O control unit 70 illustrated in FIG. 12.

The following illustrates examples of the embodiment according to the present invention and Comparative Examples. Table 1 illustrates the rising-up of the direct current component and Table 2 illustrates the result of the density of the leading end of the image.

Comparative Example 1 an image forming apparatus including no AC power supply

Comparative Example 2 an image forming apparatus including an AC power supply and the value of the current at the rising-up is equal to the value of the current at the time of transferring the image section.

Example 1 an image forming apparatus including an AC power supply and the value of the current at the rising-up is larger than the value of the current at the time of transferring the image section.

Examples 2 and 3 an image forming apparatus including an AC power supply and the rising-up output value includes two stages (a first stage output value>a second stage output value).

Examples 4 and 5 an image forming apparatus including an AC power supply, the rising-up output value includes two stages (a first stage output value>a second stage output value), and the first stage output value is 500% of the output value at the time of transferring the image section.

TABLE 1

| | Transfer bias [μA] | | |
|---|---|---|---|
| | Rising-up section | | Image |
| | First stage | Second stage | section |
| Comparative Example 1 | −40 | | −40 |
| Comparative Example 2 | −40 | | −40 |
| Example 1 | −120 | | −40 |
| Example 2 | −120 | −48 | −40 |
| Example 3 | −120 | −80 | −40 |
| Example 4 | −200 | −120 | −40 |
| Example 5 | −300 | −120 | −40 |

"First stage" and "Second stage" in the Rising-up section column in Table 1 stand for rising-up of the transfer bias in two stages. The number of stages for rising-up may be three or more.

TABLE 2

| | Image density at the leading end portion of the sheet | |
|---|---|---|
| | MM | LL |
| Comparative Example 1 | ⊙ | ○ |
| Comparative Example 2 | Δ | X |
| Example 1 | ○ | ○ |
| Example 2 | ⊙ | ○ |
| Example 3 | ⊙ | ○ |
| Example 4 | ⊙ | ⊙ |
| Example 5 | ⊙ | ⊙ |

"MM" represents a standard-temperature and standard-humidity environment, "LL" represents a low-temperature and low-humidity environment. In the column of Image density at the leading end of the sheet, "X" represents insufficient image density, "Δ" represents relatively insufficient image density, "○" represents sufficient image density, and "⊙" represents higher image density than "○".

With reference to Table 2, in examples of the embodiment according to the present invention, if an AC power supply (a power supply capable of applying alternating current component) is used, the output of the direct current component can provide sufficient image density on the leading end of the sheet.

Figure 13:
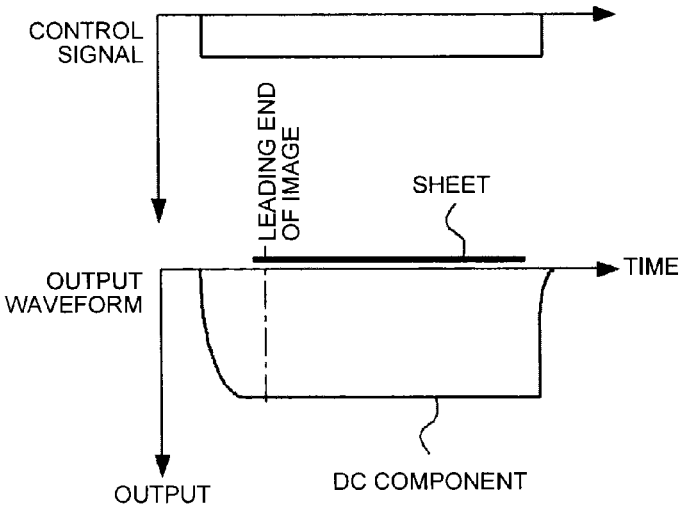
FIG. 13 is a schematic diagram illustrating control signals and an output waveform of a direct current component in Comparative Example 1 according to the embodiment.

If no AC power supply is used like Comparative Example 1 and if the transfer bias rises up with the value equal to the value at the time of transferring the image section, as illustrated in FIG. 13, the voltage is sufficient. By contrast, if an AC power supply is used like Comparative Example 2 and if the transfer bias rises up with the value equal to the value at the time of transferring the image section, as illustrated in FIG. 14, the rising-up of the direct current component is so slow that insufficient density occurs as listed in Table 2.

Figure 14:
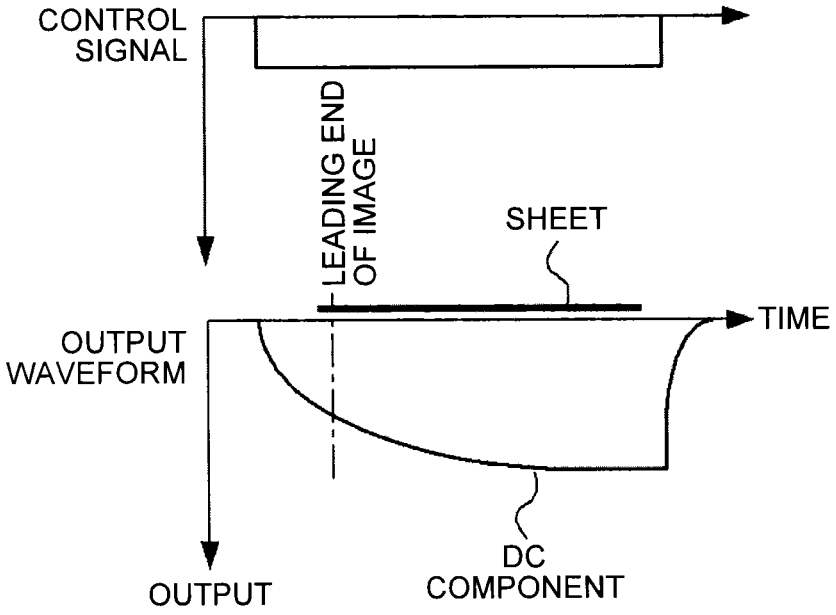
FIG. 14 is a schematic diagram illustrating control signals and an output waveform of a direct current component in Comparative Example 2 according to the embodiment.

The upper graphs in FIGS. 13 and 14 represent the control signals and the lower graphs represent the waveforms of the current or the voltage output to the repulsive roller. As illustrated in the graphs, actual output waveforms rise up gradually rather than vertically like the output target value (the control signals). If the output waveform has not risen up to the necessary value until the time of transferring the toner image at the leading end of the image as illustrated in FIG. 14 (Comparative Example 2), insufficient density occurs on the image section.

In Example 1, the output waveform rises up with a larger value than the bias at the time of transferring the image section so that the output waveform has risen up to the necessary value until the time of transferring the toner image at the leading end of the image. As a result, as illustrated in Table 2, the density is sufficient for transferring the toner image at the leading end of the image.

In Example 2, the bias rises up in two stages of output. This rises up the output desirably to obtain the value necessary for transferring the toner image at the leading end of the image, and desirable image density is achieved at the leading end of the sheet, as illustrated in Table 2. For rising up of the bias in two stages, the output target value in the first stage is determined to be preferably larger than the output target value in the second stage. The output target value in the first stage is also preferably determined to be 300% or larger of the output target value at the time of transferring the image section. In addition, the output target value in the second stage is preferably determined to be 120 to 300% of the output target value at the time of transferring the image section. The output target value in the second stage in Example 2 is 120% of the output target value at the time of transferring the image section. The output target value in the second stage in Example 3 is 200% of the output target value at the time of transferring the image section.

The direct current component rises up in two stages because in the first stage, the direct current component preferably rises up as quickly as possible by using a considerably large output target value (the control signals), and if so large output target value is maintained after the sheet enters the transfer nip, an electric discharge occurs. To address this, the direct current component rises up in two stages, (the output target value in the second stage<the output target value in the first stage), thereby achieving a quick rising-up and preventing an electric discharge.

Figure 15:
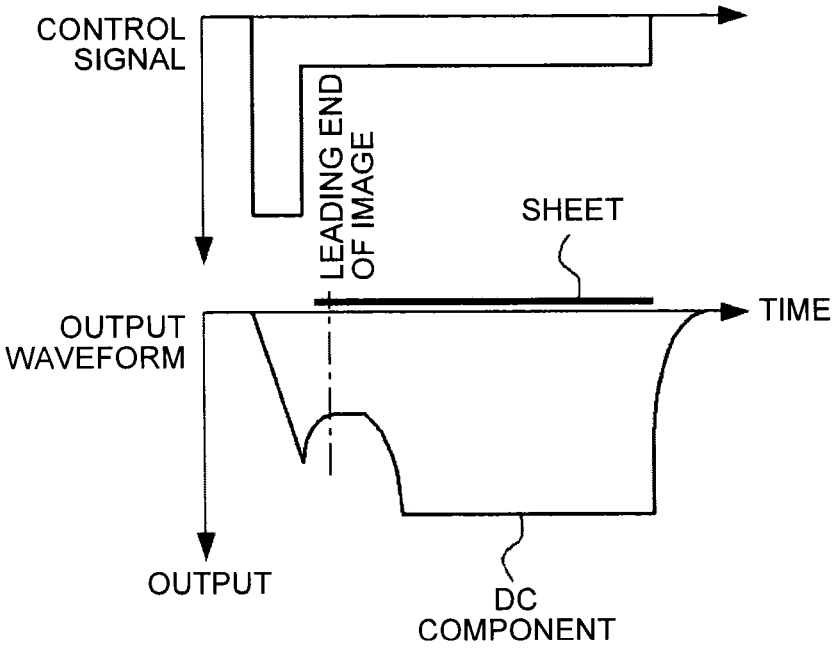
FIG. 15 is a schematic diagram illustrating control signals and an output waveform of a direct current component in Comparative Example 1 in a low-temperature and low-humidity environment according to the embodiment.
Figure 16:
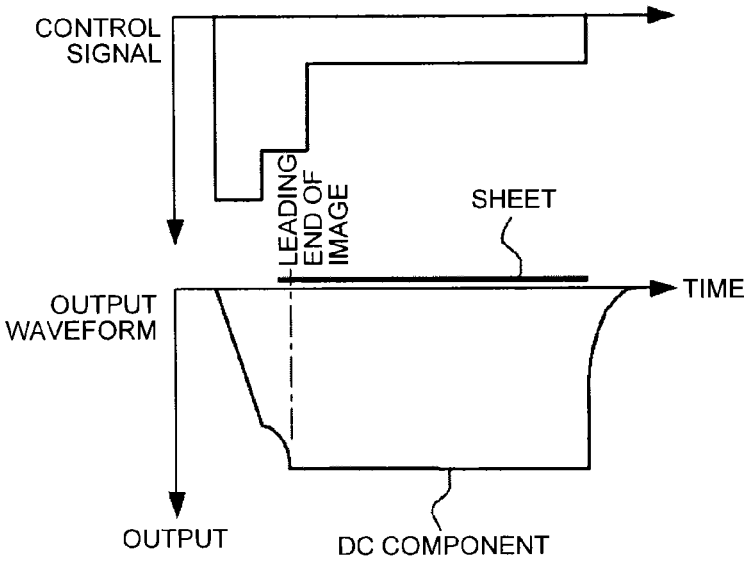
FIG. 16 is a schematic diagram illustrating control signals and an output waveform of a direct current component in Comparative Example 2 in a low-temperature and low-humidity environment according to the embodiment.

The quick rising-up in two stages has a significant advantageous effect in a low-temperature and low-humidity environment (an LL environment) to prevent insufficient density at the leading end of the image in the LL environment. FIGS. 15 and 16 illustrate output waveforms in LL environments in Examples 1 and 2, respectively.

Because the direct current component rises up slowly in the LL environment, it has not been fully raised at the time of transferring the toner image at the leading end of the image in Example 1 as illustrated in FIG. 15, which may cause insufficient density at the leading end of the sheet. By contrast, if the direct current component rises up in two stages in Example 2, as illustrated in FIG. 16, a quick rising-up is achieved in the LL environment, accordingly, no insufficient density occurs at the leading end of the image of the sheet in the LL environment. It should be noted that in a normal-temperature and normal-humidity environment, no insufficient density occurs also in Example 1.

In Examples 4 and 5, the output target value in the first stage is determined to be so large that is 500% or larger of the output target value at the time of transferring the image section. It is found that this achieves desirable density at the leading end of the image also in the LL environment. In Examples 4 and 5, the output target value in the second stage is determined to be 300% of the output target value at the time of transferring the image section. Although in Examples 2 to 5 the direct current component rises up in two stages, it may rise up in three or more stages instead.

As described above, in the embodiment according to the present invention, the output target value of the direct current component (the target value of the voltage or the target value of the current) when the direct current component in the transfer bias rises up is larger than the output target value of the direct current component (the target value of the voltage or the target value of the current) at the time of transferring the image section (when images are transferred onto a recording material), resulting in the direct current component quickly rising up. This achieves acquiring high-quality images while providing sufficient image density on both the recessed portions and the protruding portions on the surface of a recording sheet, without decreasing image density at the leading end of the recording sheet.

The output target value (the control signals) of the direct current component when the direct current component rises up is preferably determined to be 300% or larger of the output target value at the time of transferring the image section. This can cause the direct current component to rise to the value necessary for transferring the toner image at the leading end of the image.

Rising-up of the direct current component in two or more stages achieves a quick rising-up and prevents an electric discharge. When rising-up of the direct current component in two or more stages, the output target value in the second stage is preferably determined to be 120 to 300% of the output target value at the time of transferring the image section.

If the transfer bias for transferring images onto the sheet is controlled through constant current control, the output target value of the current when the direct current component rises up is preferably determined to be 300% or larger of the output target value of the current at the time of transferring the image section (when the image is transferred onto the recording sheet).

The printer according to the embodiment includes two modes of transfer bias: a DC mode and an AC+DC mode. In the DC mode only a direct current component is applied, and in AC+DC mode the superimposed transfer bias (the direct current component+the alternating current component) is applied as the transfer bias. In both of the two modes, the output target value of the direct current component when the direct current component rises up can be determined to be larger than the output target value at the time of transferring the image section (when images are transferred onto a recording material) as described above.

In addition, the direct current component rises up in two stages or more, the stage of rising-up of the direct current component preferably shifts from the first stage to the second stage at the timing when the sheet enters the transfer nip. This is because the output target value in the first stage is so large that an excessive bias is often output to the repulsive roller 33 during image transfer, therefore, the output target value in the first stage is preferably not used for transferring images. In the printer according to the embodiment, the timing of enter of the sheet to the transfer nip is determined based on the drive timing of a pair of registration rollers 101.

If the superimposed transfer bias is applied, the alternating current component is controlled so as to rise up after rising-up of the direct current component. This is because the rising-up of the direct current component requires a longer time than that of the alternating current component.

The electric resistance of members forming the transfer nip (the repulsive roller 33 and the secondary transfer roller 36 in the printer illustrated in FIG. 1) varies depending on a usage environment. Accordingly, the time required for rising-up of the direct current component in the transfer bias also varies depending on the usage environment. The image forming apparatus may therefore employ a temperature detecting unit or a humidity detecting unit for detecting the state of the environment to control (change) the above-described time for rising-up of the direct current component according to the detected result of the detecting unit.

For example, in the printer illustrated in FIG. 1, a temperature and humidity sensor 110 is disposed on the position between the secondary transfer unit and the paper feeding unit, as a detecting unit of environmental conditions. The output from the temperature and humidity sensor 110 is input to the control unit 60. The above-described time for rising-up of the direct current component is controlled according to the detected result by the temperature and humidity sensor 110, thereby high-quality images can be acquired.

Low temperature increases the electric resistance of the transfer roller and the electric resistance for transfer (low humidity decreases the amount of moisture included in the sheet of paper and thus increases the electric resistance of the sheet of paper), and requires a larger value of bias for transfer. Longer time for rising-up of the direct current component is therefore required to obtain the necessary voltage.

High temperature decreases the electric resistance of the transfer roller and the electric resistance for transfer (high humidity increases the amount of moisture included in the sheet of paper and thus decreases the electric resistance of the sheet of paper), and requires a smaller value of bias for transfer. Shorter time for rising-up of the direct current component is therefore required to prevent an excessive voltage from applying to the apparatus.

The following Table 3 illustrates an example of control of the time for rising-up of the direct current component.

Hereinafter, a "boost rise time" stands for the time period for outputting the bias with a large output target value for rising-up of the direct current component of the transfer bias (the output target value larger than the output target value at the time of transferring the image section). This applies not only to the examples in which the direct current component of the transfer bias rises up in a single stage as illustrated in FIGS. 11 and 15, but also to the examples in which the direct current component of the transfer bias rises up in two stages (or three or more stages) as illustrated in FIG. 16, and to the later-described modification in which different control signals are used between the output target value for rising-up of the direct current component and the output target value at the time of transferring the image section.

TABLE 3

| Temperature and humidity | 10° C., 15% | 23° C., 50% | 27° C., 80% |
|---|---|---|---|
| Boost rise time | 50 msec | 24 msec | 10 msec |

As illustrated in Table 3, the boost rise time is controlled to 24 milliseconds for a normal-temperature and normal-humidity environment (e.g., 23° C., 50%), 50 milliseconds for the LL environment (e.g., 10° C., 15%), and 10 milliseconds for a high-temperature and high-humidity environment (e.g., 27° C., 80%). The classification of the temperature and humidity is provided merely for exemplary purpose and not limiting. Appropriate values may be set according to the configuration of apparatuses.

The image forming apparatus may therefore include a resistance detecting unit for detecting the electric resistance of members forming the transfer nip (the repulsive roller 33 and the secondary transfer roller 36 in the printer illustrated in FIG. 1 to control (change) the above-described time for rising-up of the direct current component according to the detected result of the detecting unit. For example, in the printer illustrated in FIG. 1, a resistance detecting unit 120 is disposed for detecting the electric resistance of the repulsive roller 33. The output from the resistance detecting unit 120 is input to the control unit 60. Specifically, the resistance detecting unit 120 is an ammeter or a voltmeter. The resistance detecting unit may also be provided in the power supply 39.

If the resistance detecting unit 120 detects a high resistance value, higher bias is required for transferring images. The rise time of the direct current component therefore needs to be longer to obtain the necessary voltage.

If the resistance detecting unit 120 detects a low resistance value, lower bias is required. The rise time of the direct current component therefore needs to be shorter to prevent an excessive voltage from applying to the apparatus.

For the control of the resistance detecting unit 120 according to the detected results, the detected results may be classified into three groups, that is, high resistance, middle resistance, and low resistance, in the same manner for the control by the temperature and humidity sensor 110 as a detecting unit of environmental conditions. The values of the boost rise time may be set for these groups. Typical resistance detecting units may be employed. The classification of the resistance values and the boost rise time may be set according to the configuration of the apparatus. In addition, the control by environmental conditions and the control by resistance may be combined with each other.

The following describes a modification of the embodiment.

Figure 17:
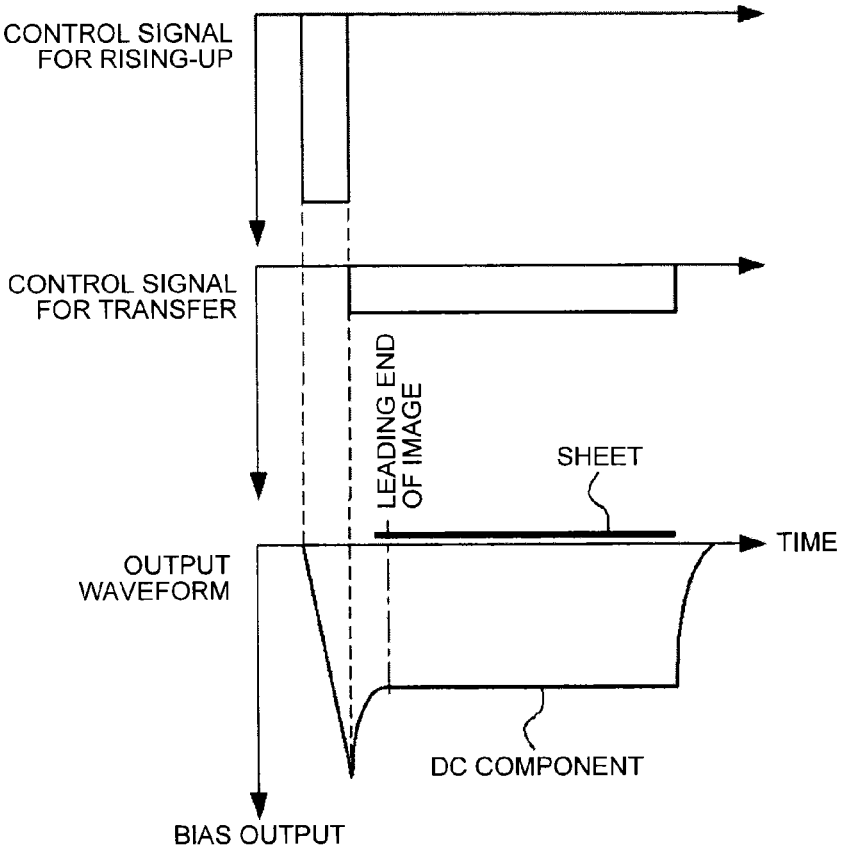
FIG. 17 is a waveform diagram for explaining control signals and rising-up of a direct current component in the printer according to a modification of the embodiment.
Figure 18:
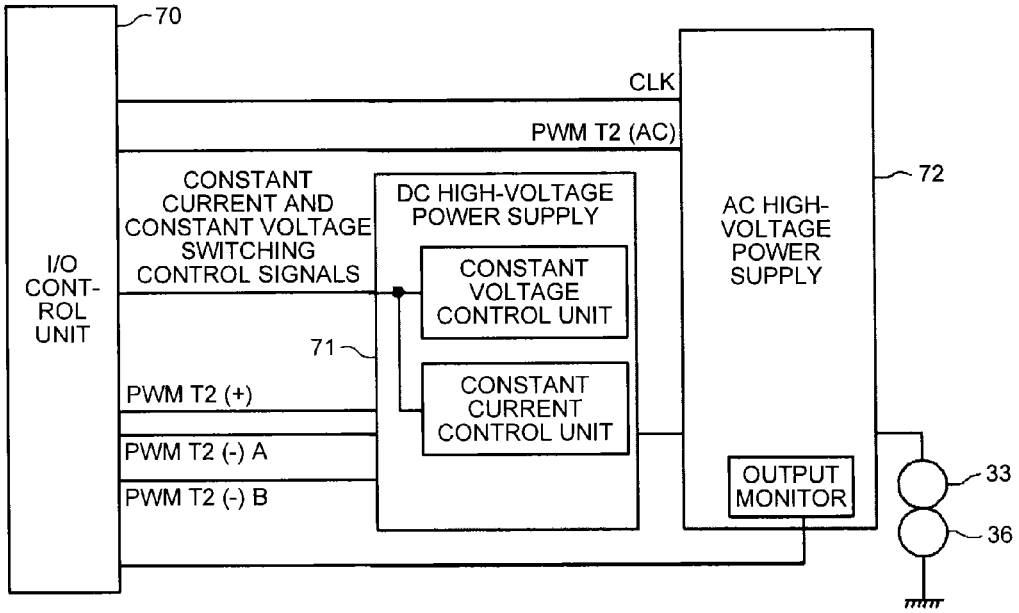
FIG. 18 is a block diagram illustrating the configuration of power supplies in the printer according to the modification of the embodiment.

FIG. 17 is a waveform diagram for explaining control signals and rising-up of a direct current component in the printer according to a modification of the embodiment. FIG. 18 is a block diagram illustrating the configuration of power supplies in the printer according to the modification of the embodiment.

The control for rising-up of the direct current component in the modification is different from the control illustrated in FIG. 11 in that control signals for rising-up and the control signals for transferring images are used. Use of two types of control signals for control generates no output error in the bias for transfer. In addition, the bias for transfer can be precisely output while a large value of the bias for rising-up is output to the repulsive roller without increasing the capacity of the storing area in the control unit.

Use of the above-described two types of control signals for rising-up of a direct current component requires the configuration of the power supply as illustrated in FIG. 18 in the printer in the modification. This includes two PWM signal lines, which is different from the configuration of the power supply as illustrated in FIG. 12.

The I/O control unit 70 outputs control signals for rising-up PWM T2(−)B through a signal line for output control signals PWM T2(−)B to the DC high-voltage power supply 71. The I/O control unit 70 also outputs control signals for transfer PWM T2(−)A through a signal line for output control signals PWM T2(−)A to the DC high-voltage power supply 71.

The control signals for transfer PWM T2(−)A is signals that output to the repulsive roller 33 the bias for transfer for transferring toner image onto the recording sheet P. The output target value (the duty ratio) of the signals are adjusted for the best transfer conditions if any change occurs on the temperature and humidity environment of the apparatus or the electric resistance of the member(s) forming the transfer nip.

The control signals for rising-up PWM T2(−)B is signals that outputs to the repulsive roller 33 the bias for rising-up larger than the bias for transferring the toner images onto the recording sheet P in order to cause the direct current component to quickly rise up.

If the bias for rising-up and the bias for transfer are both controlled through a single output control signals, the maximum value (the duty ratio is 100%) of the output target value (the duty ratio) of the signals needs to correspond to the bias for rising-up, which is a large bias. The output target value of the bias for transfer, therefore, needs to be adjusted in a small range. For example, if the output target value of the bias for rising-up is 100%, the output target value of the bias for transfer in a low-humidity environment is 20%, and the output target value of the bias for transfer in middle-humidity environment is 64% of the output target value of the bias for transfer in the low-humidity environment, the output target value of the bias for transfer in the middle-humidity environment is 12.8%. The output target value of the bias for transfer therefore needs to be adjusted in such a small range from 12.8 to 20%. This often causes errors on the duty ratio output as the output target value of the bias for transfer. Alternatively, this requires such a large capacity of the storing area in the apparatus for storing values with many digits for setting the output target value.

In the present modification, the bias for rising-up and the bias for transfer are controlled by using different output control signals, thereby reducing errors that occur on the output target value of the bias for transfer and saving the capacity of the storing area in the control unit. This achieves precisely outputting the bias for transfer to the repulsive roller while outputting a large value of the bias for rising-up to the repulsive roller.

In FIG. 18, the signal line for the output control signals PWM T2(−)B and the signal line for the output control signals PWM T2(−)A are illustrated as individual signal lines. A common signal line, however, may be used for the output control signals PWM T2(−)B and the output control signals PWM T2(−)A because it suffices that the output control signals PWM T2(−)B and the output control signals PWM T2(−)A are used individually.

Figure 19:
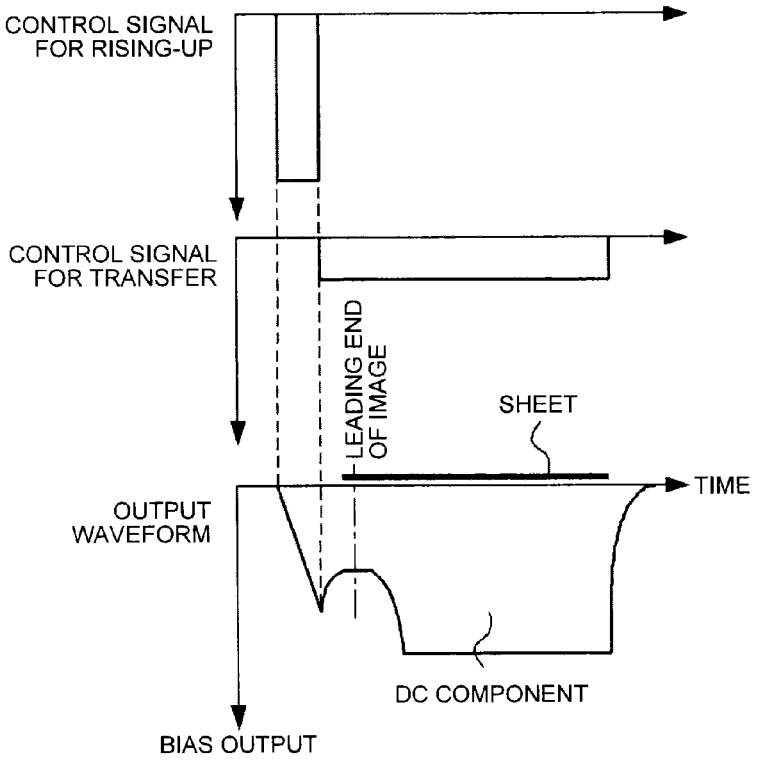
FIG. 19 is another waveform diagram for explaining control signals and rising-up of a direct current component in the modification of the printer according to the embodiment.

FIG. 19 is another waveform diagram for explaining control signals and rising-up of a direct current component in the modification of the printer according to the embodiment. This is different from FIG. 15 in that different control signals are used, that is, the control signals for rising-up and the control signals for transferring images. This reduces errors that occur on the output target value of the bias for transfer and saves the capacity of the storing area in the control unit, in the same manner as the example illustrated in FIG. 17.

Figure 20:
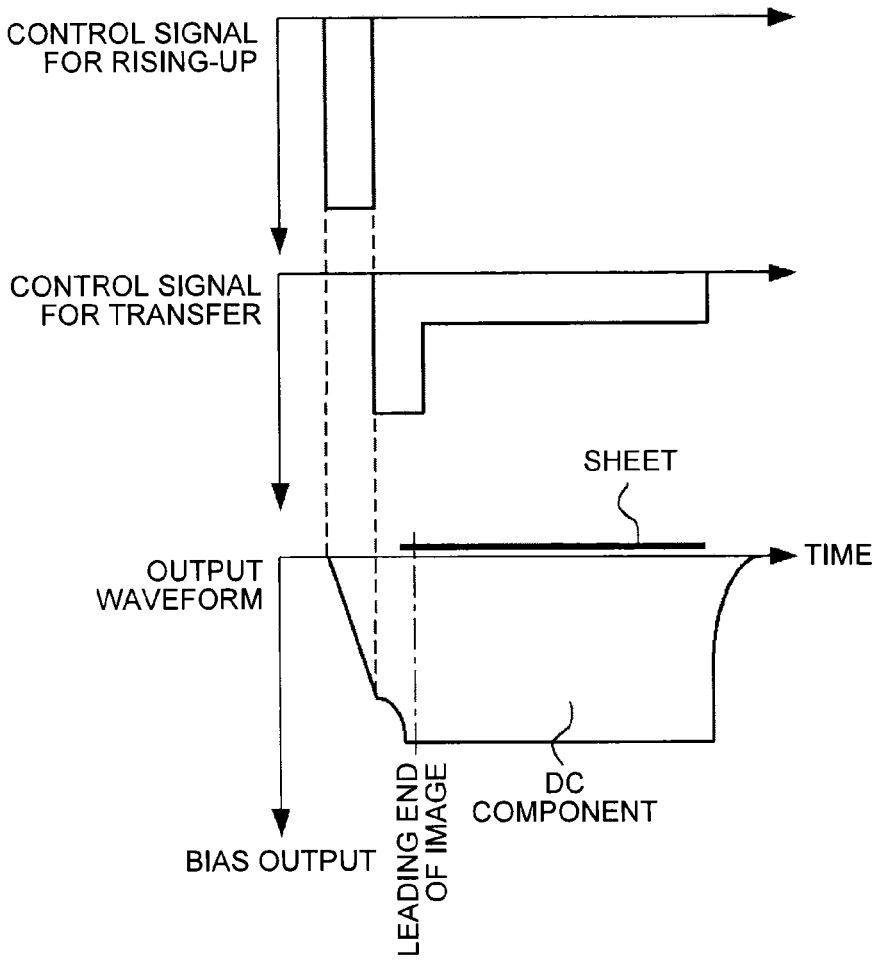
FIG. 20 is still another waveform diagram for explaining control signals and rising-up of a direct current component in the modification of the printer according to the embodiment.

FIG. 20 is still another waveform diagram for explaining control signals and rising-up of a direct current component in the modification of the printer according to the embodiment. This is different from FIG. 16 in that different control signals are used, that is, the control signals for rising-up and the control signals for transferring images. This reduces errors that occur on the output target value of the bias for transfer and saves the capacity of the storing area in the control unit, in the same manner as the example illustrated in FIG. 17. In addition, the example includes the following functions.

Under the control illustrated in FIG. 20, the bias for rising-up in the first stage is output through the output control signals PWM T2(−)B, and the bias for rising-up and the bias for transfer are output through the output control signals PWM T2(−)A.

When switching the output control signals from the PWM T2(−)B to the PWM T2(−)A, the control may be delayed or an error may occur on the switching timing, resulting in temporarily decreasing the output of the bias.

In the control illustrated in FIG. 20, the switching timing of output control signals is set so that the leading end of the image reaches the transfer nip after the output control signals are switched from the first stage to the second stage. This prevents insufficient image density of images at the leading end resulting from the temporary small output and achieves high-quality images.

As described above, the output target value of the power supply in the printer according to the present embodiment is controlled as the waveforms of the control signals illustrated in FIGS. 11, 15 to 17, 19, and 20 or as Examples 1 to 5 listed in Table 1. Specifically, the printer includes the intermediate transfer belt 31 on which the toner images are carried; the secondary transfer roller 36 that forms the secondary transfer nip N between itself and the intermediate transfer belt 31; the power supply 39 capable of outputting the superimposed transfer bias in which the alternating current component is superimposed onto the direct current component; and the control unit 60 that controls the power supply 39. The printer transfers the toner image on the intermediate transfer belt 31 onto the recording sheet P at the secondary transfer nip N through the superimposed transfer bias or the direct current bias including the direct current component only output from the power supply 39. In the printer, the control unit 60 controls the power supply 39 so that the output target value (the value of the control signals) of the direct current component at the rise time of the direct current component is larger than the output target value (the value of the control signals) of the direct current component at the time of transferring the toner image onto the recording sheet P.

This can cause the direct current component of the transfer bias to quickly rise up. In addition, high-quality images can be acquired while providing sufficient image density on both the recessed portions and the protruding portions on the surface of a recording sheet P, without decreasing image density at the leading end of the recording sheet.

The power supply of the printer may be controlled so that the output of the direct current component of the bias output to the opposite member forms one of the output waveforms illustrated in FIGS. 11 and 17. Specifically, the printer includes the intermediate transfer belt 31 on which the toner images are carried; the secondary transfer roller 36 that forms the secondary transfer nip N between itself and the intermediate transfer belt 31; the repulsive roller 33 provided opposite to the secondary transfer roller 36 with the intermediate transfer belt 31 interposed therebetween at the intermediate transfer belt 31, the power supply 39 capable of outputting the superimposed transfer bias in which the alternating current component is superimposed onto the direct current component; and the control unit 60 that controls the power supply 39. The printer transfers the toner image on the intermediate transfer belt 31 onto the recording sheet P at the secondary transfer nip N through the superimposed transfer bias or the direct current bias including the direct current component only output from the power supply 39. In the printer, the control unit 60 controls the power supply 39 so that the output to the secondary transfer roller 36 or the repulsive roller 33 at the rise time of the direct current component is larger than the output of the direct current component at the time of transferring the toner image onto the recording sheet P.

This can cause the direct current component of the transfer bias to quickly rise up more surely if a resistance change occurs on the intermediate transfer belt 31, the secondary transfer roller 36, and/or the repulsive roller 33 or an output change occurs on the power supply. In addition, high-quality images can be acquired while providing sufficient image density on both the recessed portions and the protruding portions on the surface of a recording sheet P, without decreasing image density at the leading end of the recording sheet.

The embodiment and the modification according to the present invention are described above for exemplary purpose with reference to the accompanying drawings. The transferring part can be structured in other forms appropriately so as to include a belt on the side of the opposite member, for example. The power supply capable of outputting the superimposed transfer bias may be a widely known power supply including an appropriate configuration.

The image forming apparatus may have another configuration, such as the order of the image forming units in the tandem color printer. The present invention may also be applied to a full-color printer including three color toners or a multi-color printer including two color toners in addition to a four-color printer. The image forming apparatus is not limited to a printer and may be a copying machine, a facsimile, or a multifunction peripheral including a plurality of functions.

The present invention can also be applied to an apparatus that transfers images on a photosensitive drum to a recording sheet at a transfer nip including a photosensitive drum as an image carrier and a transfer roller as a transferring unit to a recording sheet, that is an apparatus of a direct transfer system.

Specifically, the present invention may be applied to a printer including a photosensitive drum on which the toner images are carried; a transfer roller that forms a transfer nip between itself and the photosensitive drum; a power supply capable of outputting a superimposed transfer bias in which an alternating current component is superimposed onto a direct current component; and a control unit that controls the power supply, in which the toner image on the photosensitive drum is transferred onto the recording sheet P at the transfer nip N through the superimposed transfer bias or the direct current bias including the direct current component only output from the power supply. In the printer, the control unit controls the power supply so that the output target value (the value of the control signals) of the direct current component at the rise time of the direct current component is larger than the output target value (the value of the control signals) of the direct current component at the time of transferring the toner image onto the recording sheet P.

Alternatively, the present invention may be applied to a printer including a photosensitive drum on which the toner images are carried; a transfer roller that forms a transfer nip between itself and the photosensitive drum; a power supply capable of outputting a superimposed transfer bias in which an alternating current component is superimposed onto a direct current component; and a control unit that controls the power supply, in which the toner image on the photosensitive drum is transferred onto the recording sheet P at the transfer nip N through the superimposed transfer bias or the direct current bias including the direct current component only output from the power supply. In the printer, the control unit controls the power supply so that the output of the direct current component to the transfer roller at the rise time of the direct current component is larger than the output of the direct current component to the transfer roller at the time of transferring the toner image onto the recording sheet P. In this example, the photosensitive drum is preferably grounded.

An intermediate transfer drum in a drum shape may be used instead of the intermediate transfer belt, and a secondary transfer belt may be used instead of the nip forming member (the secondary transfer roller).

Second Embodiment

The following describes an example different from the first embodiment in an image forming apparatus with the same configurations as the image forming apparatus illustrated in FIG. 1.

The intermediate transfer belt 31 in the embodiment has the following characteristics: a thickness of 20 to 200 μm, preferably, approximately 60 μm; a surface resistance of 9.0 to 13.0 Log $\Omega/cm^2$, preferably, 10.0 to 12.0 Log $\Omega/cm^2$. The surface resistance is measured with the conditions of an applied voltage of 500 V and a measurement time of 10 seconds by using a high resistivity meter, Hiresta-UP MCP HT45 manufactured by Mitsubishi Chemical Corporation and an HRS probe.

The volume resistivity thereof is in a range of from 6.0 to 13.0 Log Ωcm, preferably, 7.5 to 12.5 Log Ωcm, and more preferably, approximately 9.0 Log Ωcm. The volume resistivity is measured with the conditions of an applied voltage of 100 V for 10 seconds by a high resistivity meter, Hiresta-UP MCP HT45 manufactured by Mitsubishi Chemical Corporation and an HRS probe.

The intermediate transfer belt 31 may be structured with a single layer or multiple layers including, but not limited to, polyimide (PI), polyvinylidene fluoride (PVDF), ethylene tetrafluoroethylene (ETFE), and polycarbonate (PC).

The surface of the intermediate transfer belt 31 may be coated with a release layer, as necessary. Material for the release layer may include, but is not limited to, fluorocarbon resin such as ETFE, polytetrafluoroethylene (PTFE), PVDF, perfluoroalkoxy polymer resin (PFA), fluorinated ethylene propylene (FEP), and polyvinyl fluoride (PVF).

The intermediate transfer belt 31 is manufactured through a casting process, a centrifugal casting process, and the like. The surface of the intermediate transfer belt 31 may be polished as necessary.

Alternatively, the intermediate transfer belt 31 may be structured as a three-layered endless belt having a base layer, an intermediate elastic layer, and a surface coating layer.

When the three-layered belt is used, the base layer is made of fluorocarbon polymers having poor extensibility or a composite material composed of rubber having great extendibility and a canvas having poor extensibility. The elastic layer is made of, for example, fluorocarbon rubber, or acryleritrile-butadiene copolymer, which is formed on the base layer. The coating layer is formed by applying the fluorocarbon polymers onto the elastic layer.

The resistivity is adjusted by dispersing electrically conductive material, such as carbon black, therein.

The repulsive roller 33 includes a resistance layer and a metal core made of stainless or aluminum. The resistance layer is layered around the metal core.

The resistance layer is made of a material obtained by dispersing electroconductive particles of carbon or a metal complex in polycarbonate, a fluorine-based rubber, or a silicon-based rubber, for example. Alternatively, the resistance layer is made of a rubber such as NBR or EPDM, or an NBR/ECO copolymer rubber, or a semi-conductive rubber of polyurethane. Its volume resistance is 6.0 to 12.0 Log Ωcm, more preferably, 7.0 to 9.0 Log Ωcm.

Although both a foam type having a hardness of 20 degrees to 50 degrees and a rubber type having a rubber hardness of 30 degrees to 60 degrees can be used, since the resistance layer comes into contact with the secondary transfer roller 36 through the intermediate transfer belt 31, a sponge type that does not produce a non-contact part even with a small contact pressure is desirable. That is because the sponge type can avoid a lack of a character or a thin line that is apt to occur when a contact pressure between the intermediate transfer belt 31 and the repulsive roller 33 is large.

The secondary transfer roller 36 is formed by superimposing a resistance layer made of, e.g., an electroconductive rubber and a surface layer on a metal core made of stainless or aluminum.

The external diameter of the secondary transfer roller 36 is 20 mm, and the metal core is made of stainless with the diameter of 16 mm. The resistance layer is a JIS-A rubber that is made of an NBR/ECO copolymer and has a hardness of 40 to 60 degrees.

The surface layer is made of fluorine-containing urethane elastomer with a thickness of 8 to 24 μm. That is because the surface layer of the secondary transfer roller 36 is often manufactured in a coating process. When the thickness of the surface layer is not greater than 8 μm, an influence of unevenness in resistance due to unevenness of coating is large, and leak may occur at a position where the resistance is low. Therefore, the thickness that is not greater than 8 μm is not preferable. The problem that a surface of the secondary transfer roller 36 gets wrinkled and the surface layer is cracked is also apt to occur.

On the other hand, when the thickness of the surface layer is equal to or larger than 24 μm, the resistance is increased. If the volume resistance is high, a voltage when a constant current is applied to the repulsive roller 33 may rise up and exceeds a voltage variable range of the constant current power supply 13, and hence a current that is not greater than a target current may be provided. Alternatively, when the voltage variable range is sufficiently high, a leak can readily occur due to a high-voltage path from the constant current power supply to the repulsive roller 33 or a high voltage in the metal core of the repulsive roller 33.

Another problem is that the hardness is increased and contact with respect to the recording sheet (e.g., paper sheet) P or the intermediate transfer belt 31 is deteriorated when the thickness of the surface layer of the secondary transfer roller 36 exceeds 24 μm.

The surface resistivity of the secondary transfer roller 36 is over 6.5 Log Ω/cm$^2$ and the volume resistivity of the surface layer of the secondary transfer roller 36 is over 10.0 Log Ωcm, preferably, over 12.0 Log Ωcm.

Alternatively, the secondary transfer roller 36 has a surface layer that is made of unlaminated foamed material. In this configuration, the volume resistivity thereof is within a range of from 6.0 to 8.0 Log Ωcm, preferably, within a range from 7.0 to 8.0 Log Ωcm.

In this case, the repulsive roller 33 may be used and the volume resistivity thereof is preferably equal to or smaller than 6.0 Log Ωcm that is smaller than that of the secondary transfer roller 36.

The volume resistivities of the secondary transfer roller 36 and the repulsive roller 33 are measured by rotational measurement, similarly to the primary transfer roller 35.

Figure 22:
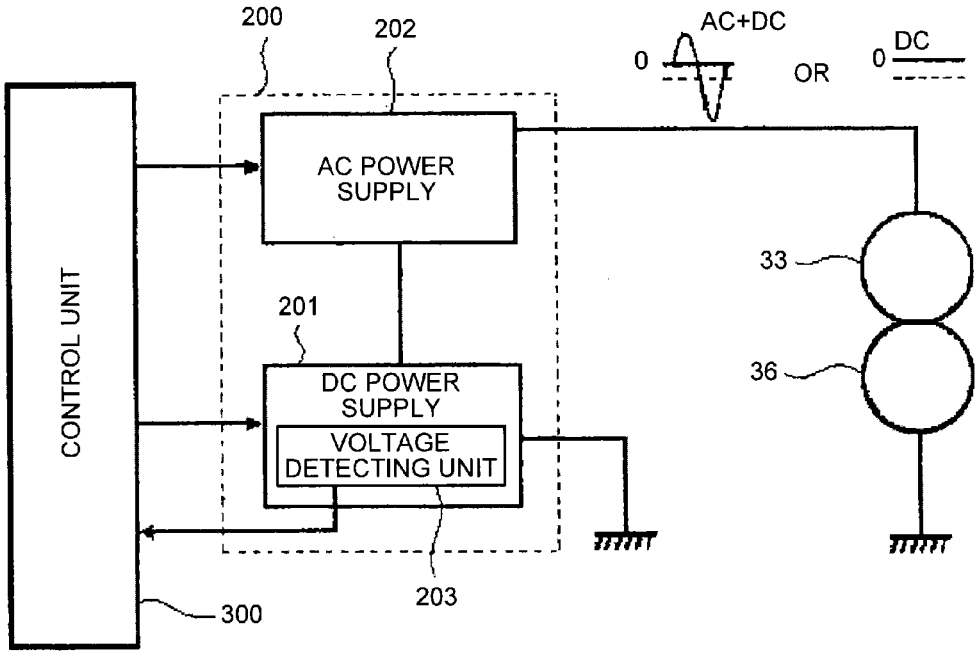
FIG. 22 is a schematic diagram illustrating the configuration of a secondary transfer bias power supply including a direct current (DC) power supply and an alternating current (AC) power supply according to the embodiment.

FIG. 22 illustrates the configuration of a secondary transfer bias power supply 200 as a secondary transfer bias output unit included in the printer according to the embodiment.

As illustrated in FIG. 22, the secondary transfer bias power supply 200 includes a direct current (DC) supply (a first power supply) that outputs a direct current component and an alternating current (AC) supply (a second power supply) that outputs an alternating current component or a current component in which an alternating current component is superimposed on a direct current component. As a secondary transfer bias, the secondary transfer bias power supply 200 outputs a direct current voltage (hereinafter, referred to as a "DC bias") and a superimposed transfer bias (hereinafter, referred to as a "superimposed transfer bias") in which an AC voltage is superimposed on a DC voltage.

The control unit 300 controls the secondary transfer bias power supply 200.

In the secondary transfer bias power supply 200 with this configuration, when the superimposed transfer bias is output, output signals are transmitted from the control unit 300 to the DC power supply 201 and the AC power supply 202, and the superimposed transfer bias is applied to the repulsive roller 33.

When the direct current bias is output, signals are transmitted from the control unit 300 to the DC power supply 201 only, and the direct current bias is applied to the repulsive roller 33.

The second power supply herein includes the AC power supply 202 that outputs the alternating current component only; however, another power supply may be included in the second power supply, such as a power supply in which the alternating current component is superimposed onto the direct current component. This configuration achieves applying the superimposed transfer bias with a low-cost and small-spaced power supply.

Figure 23:
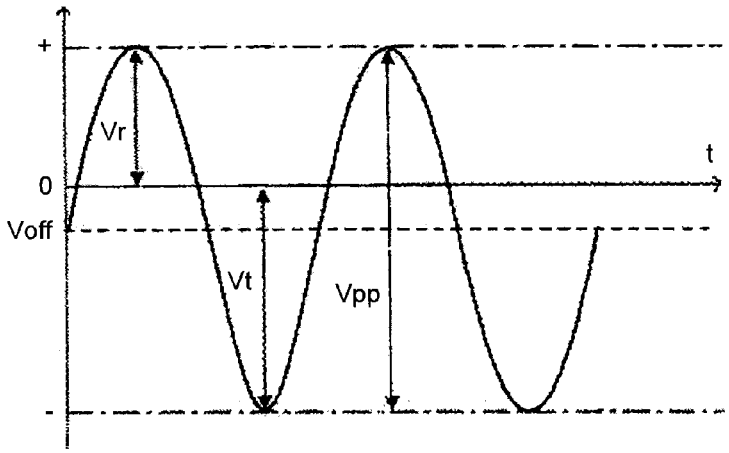
FIG. 23 is a waveform diagram illustrating an example of a superimposed transfer bias output from the DC power supply and the AC power supply according to the embodiment.

FIG. 23 is a waveform diagram illustrating an example of a superimposed transfer bias output from a DC power supply 201 and an AC power supply 202 according to the embodiment.

In FIG. 23, an offset voltage Voff is a value of a direct current (DC) component of the superimposed transfer bias. A peak-to-peak voltage Vpp is a peak-to-peak voltage of an alternating current (AC) component of the superimposed transfer bias.

The superimposed transfer bias is a value in which the peak-to-peak voltage Vpp is superimposed on the offset voltage Voff. The time-averaged value of the bias is the same as the offset voltage Voff.

As illustrated in FIG. 23, the superimposed transfer bias is a sine waveform, having plus-side peak and minus-side peak.

The minus-side peak is indicated by a value Vt, corresponding to a position at which the toner is moved from the intermediate transfer belt side to the recording sheet (negative side in the present embodiment), in the secondary transfer nip. The plus-side peak is represented by a value Vr, corresponding to a position direction in which the toner is returned to the intermediate transfer belt side (positive side in the present embodiment).

By applying the superimposed transfer bias including the direct current and setting the offset voltage Voff (applied time-averaged value) to the same polarity as the toner (negative in the present embodiment), the toner is reciprocally moved and is relatively moved from the intermediate transfer belt side to the recording sheet P. Thus, the toner is transferred on the recording sheet P.

It is to be noted that although in the present embodiment a sine waveform is used as the alternating voltage, a rectangular wave may be used as the alternating current voltage.

Herein, a time period during which the toner of the alternating-current component is moved from the belt side to the recording sheet side (negative side in the present embodiment), and the time period during which the toner is returned from the recording sheet side to the intermediate transfer belt side (positive side in the present embodiment) can be set different time.

Figure 24:
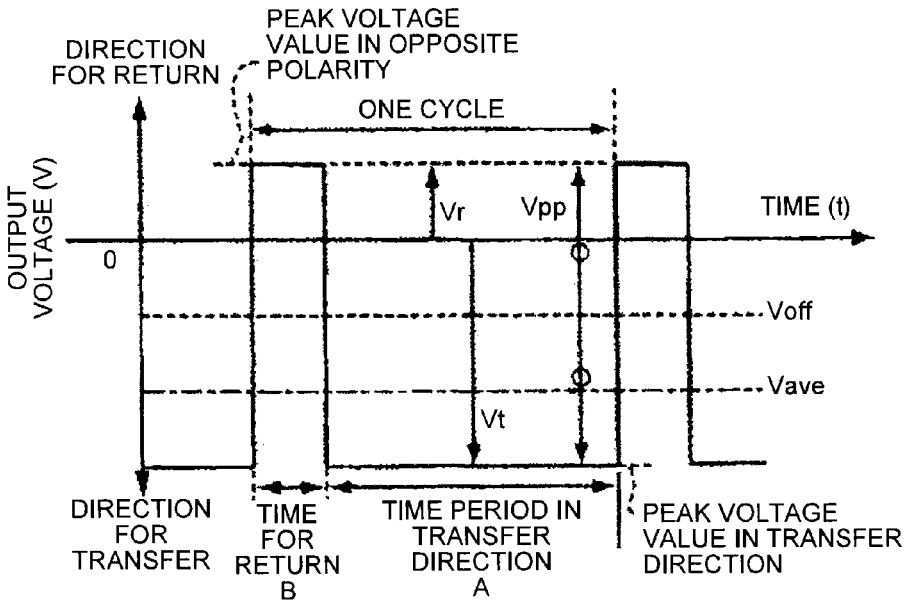
FIG. 24 is a graph illustrating examples of a time for moving toner from the side of an intermediate transfer belt to the side of a recording sheet and a time for returning toner from the side of the recording sheet to the side of the intermediate transfer belt in a direct current component in the printer according to the embodiment.

As illustrated in FIG. 24, in one cycle in the alternating component, a time period A during which the toner is moved from the intermediate transfer belt side to the recording sheet side is set greater than a time period B during which the toner is returned from the recording sheet to the intermediate transfer belt side.

The waveform illustrated in FIG. 24 is an example, any ratio of the time period A in the transfer direction to the time period B in the returning direction can be set as appropriate.

When a rough sheet having large asperity (e.g., Japanese paper, or an embossed sheet) is used as the recording sheet P, the toner image is transferred in the superimposed transfer mode. By applying the superimposed transfer bias, while the toner is reciprocally moved and relatively moved from the intermediate transfer belt side to the recording sheet P side to transfer the toner onto the recording sheet P. With this configuration, transfer performance to concave portions of the rough sheet can be improved, and entire transfer efficiency is improved, thereby preventing the formation of extraordinary images, such as images with white spots in which the toner is not covered with the concave portion.

It has been known that, however, applying the transfer bias including the superimposed transfer bias is likely to generate transfer dust particles compared to the case when the transfer bias consisting of the DC voltage is applied. The transfer dust particles refers to a phenomenon that particles of toner are scattered during the transfer process around the transferred image section.

A higher frequency of the alternating current component of the transfer bias increases the number of reciprocating motion of the toner between the intermediate transfer belt 51 and the recording sheet P in the secondary transfer nip, resulting in readily generating transfer dust particles. Optimizing the frequency can reduce the transfer dust particles, but some environmental conditions may cause transfer dust particles.

By contrast, when using a recording sheet P having small asperity such as a plain transfer sheet of paper, (e.g., smooth paper, coated paper), applying the secondary transfer bias consisting of the direct current component achieves sufficient transferability.

Some types of the recording sheet P require no superimposed transfer bias. In this example, only the direct current bias, not the alternating current bias, is applied because sufficient transferability is achieved without applying the superimposed transfer bias. This can reduce generation of transfer dust particles.

By switching two types of application of bias between applying the direct current bias when using a recording sheet P having small asperity such as a plain transfer sheet of paper; and applying the superimposed transfer bias when using a recording sheet P having large asperity achieves sufficient transferability on various types of recording sheet P. This also leads to the long service life of the apparatus because the AC power supply 202 is turned ON only the time the AC power is required.

The following describes a rise time of the high-pressure output using the superimposed transfer bias and rise time of the high-pressure output using the direct current bias.

Figure 25:
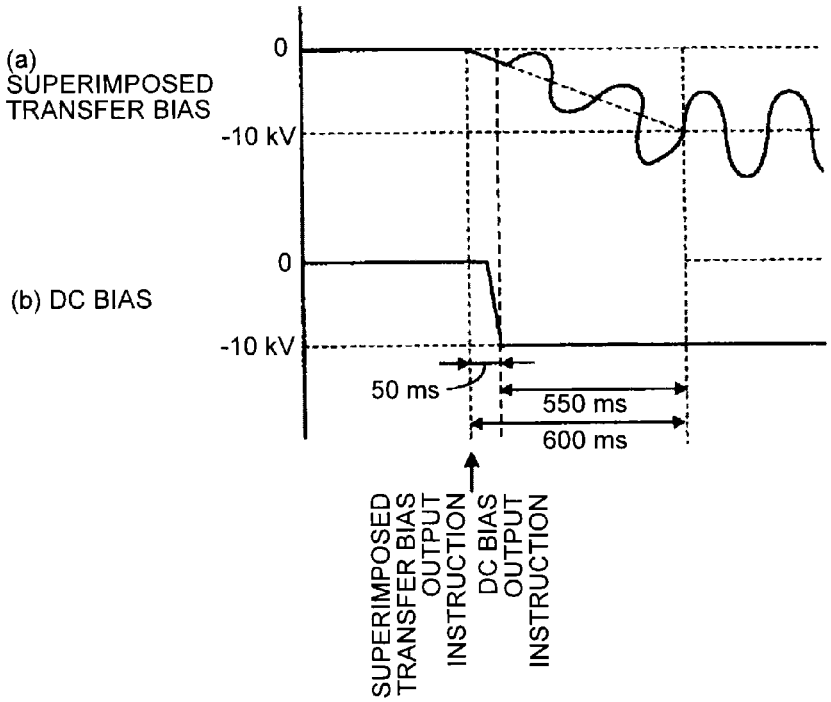
FIG. 25 illustrates examples of a rise time of a high-pressure output by using the superimposed transfer bias and a rise time of a high-pressure output by using the direct current bias according to the embodiment.

FIG. 25 illustrates examples of a rise time of a high-pressure output by using the superimposed transfer bias and a rise time of a high-pressure output by using the direct current bias according to the embodiment. FIG. 8 is a view illustrating the configuration of the secondary transfer bias power supply 200 including the DC power supply 201.

The rising-up refers to shifting from the status no electric potential exists (0 kV) to the status any electric potential exists regardless of the polarity of the electric potential. The fall refers to shifting from the status any electric potential exists to the status no electric potential exists (0 kV) regardless of the polarity of the electric potential.

Figure 26:
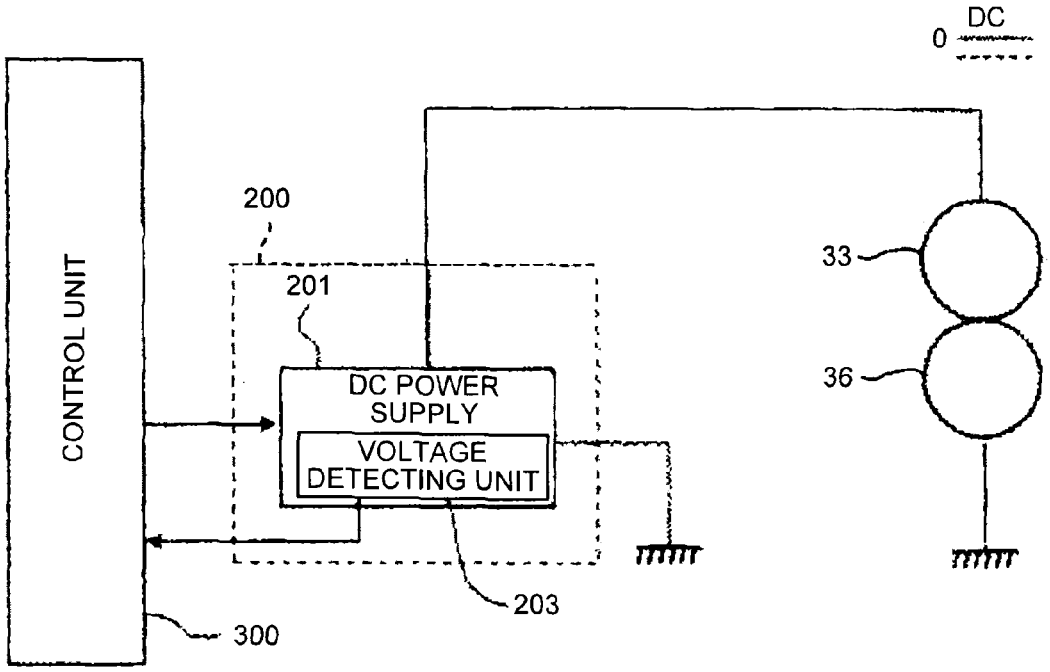
FIG. 26 is a schematic diagram illustrating the configuration of a secondary transfer bias power supply including a DC power supply according to the embodiment.

If the secondary transfer bias power supply 200 illustrated in FIG. 26 is used to output the direct current bias only with a high pressure under the constant current control, the rise time of the direct current bias is as illustrated in (b) of FIG. 25.

That is, it takes a time period of 50 ms from the time the direct current bias is instructed to be output to the secondary transfer bias power supply 200 to the time the bias value of the secondary transfer bias power supply 200 reaches the intended value (e.g., approx. −10 kV).

The output instruction of the direct current bias to the secondary transfer bias power supply 200 is issued through outputting output signals of the direct current bias to the secondary transfer bias power supply 200.

By contrast, the superimposed transfer bias is output with a high pressure by using the secondary transfer bias power supply 200 illustrated in FIG. 22 under the constant current control, the rise time of the superimposed transfer bias is as illustrated in (a) of FIG. 25.

That is, it takes a time period of 600 ms from the time the superimposed bias is instructed to be output to the secondary transfer bias power supply 200 to the time the bias value of the secondary transfer bias power supply 200 reaches the intended bias value (e.g., approx. −10 kV).

The output instruction of the superimposed bias to the secondary transfer bias power supply 200 is issued through outputting output signals of the superimposed bias to the secondary transfer bias power supply 200.

As described above, if the secondary transfer bias power supply 200 is used to output the superimposed bias with a high pressure, a longer time is required until the bias value of the secondary transfer bias power supply 200 reaches the intended value compared to the example when outputting the direct current bias with a high pressure.

The AC power supply 202 includes a capacitor for adjusting the load. The capacitor maintains an alternating current waveform by having a certain amount of capacity. By contrast, the direct current component of the superimposed transfer bias is controlled under the constant current control and outputs with a specified small amount of current to prevent inrush current. This is because charging the direct current component of the superimposed transfer bias with the capacitor for adjusting the load requires a certain time period. This delays the rise time of the voltage.

The alternating current component of the superimposed transfer bias is also charged to the capacitor for adjusting the load. The alternating current component of the superimposed transfer bias is, however, controlled under the constant voltage control, thus superimposing a large voltage from the beginning causes no problem, requiring a short time period for charging the capacitor for adjusting the load.

In the image forming apparatus disclosed in Japanese Patent Application Laid-open No. 2008-275844, when the image section on the recording sheet is passing through the secondary transfer unit, the transfer power supply for outputting only the DC voltage is controlled under the constant voltage control and the transfer bias is applied. The transfer bias applied when the image section on the recording sheet is passing through the secondary transfer unit is corrected depending on the number of printed sheet, the type of paper, or the thickness of paper according to the voltage value measured when no recording sheet exists in the secondary transfer unit.

By contrast, in the embodiment, the direct current component of the transfer bias applied at the rise time of the bias, not at the time of transferring image is controlled under the constant voltage control. In addition, the direct current component of the transfer bias applied when the image section on the recording sheet is passing through the secondary transfer unit is controlled under the constant current control.

Figure 21:
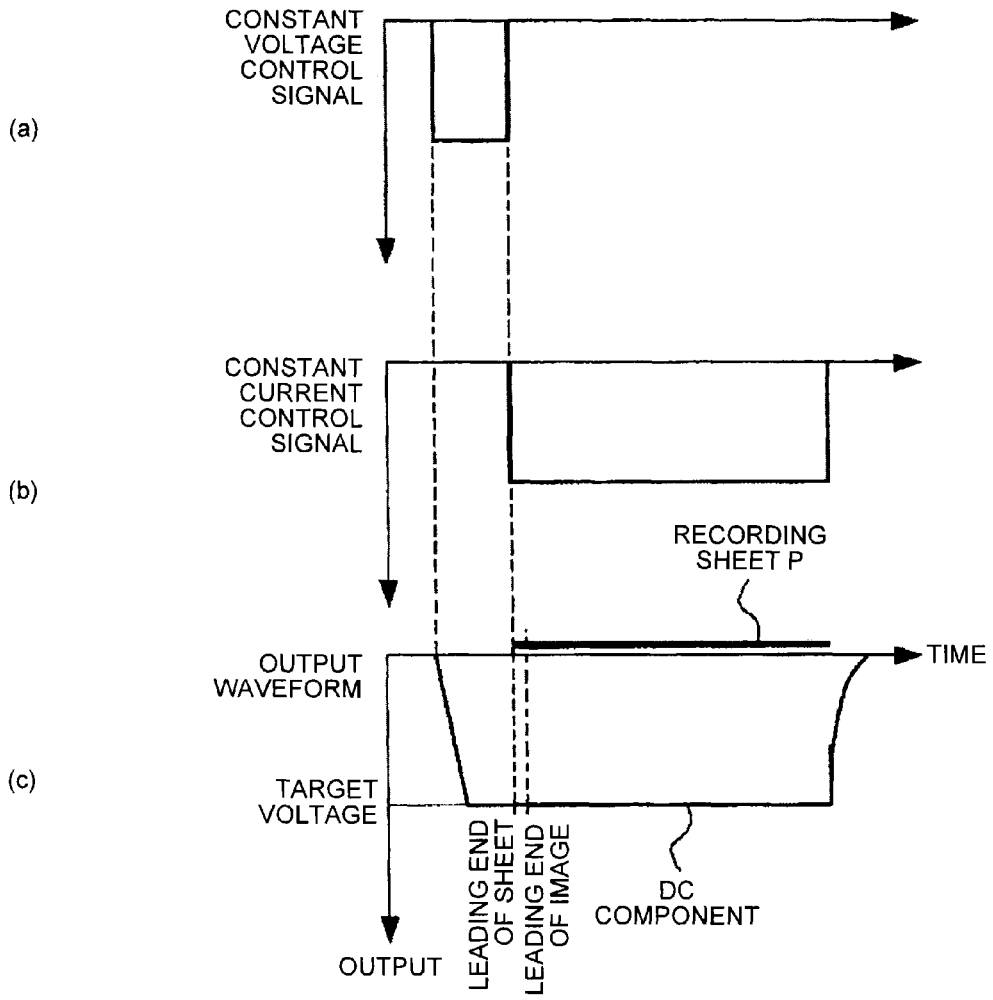
FIG. 21 illustrates control signals or an output waveform of a direct current component of a superimposed transfer bias according to the embodiment.

FIG. 21 illustrates control signals or an output waveform of a direct current component of a superimposed transfer bias according to the embodiment. In FIG. 21, (a) illustrates the waveform of the constant voltage control signals transmitted from the control unit 300 to the secondary transfer bias power supply 200. In FIG. 21, (b) illustrates the waveform of the constant current control signals transmitted from the control unit 300 to the secondary transfer bias power supply 200. In FIG. 21, (c) illustrates the output of the bias (the current or the voltage) output to the repulsive roller 33.

Figure 27:
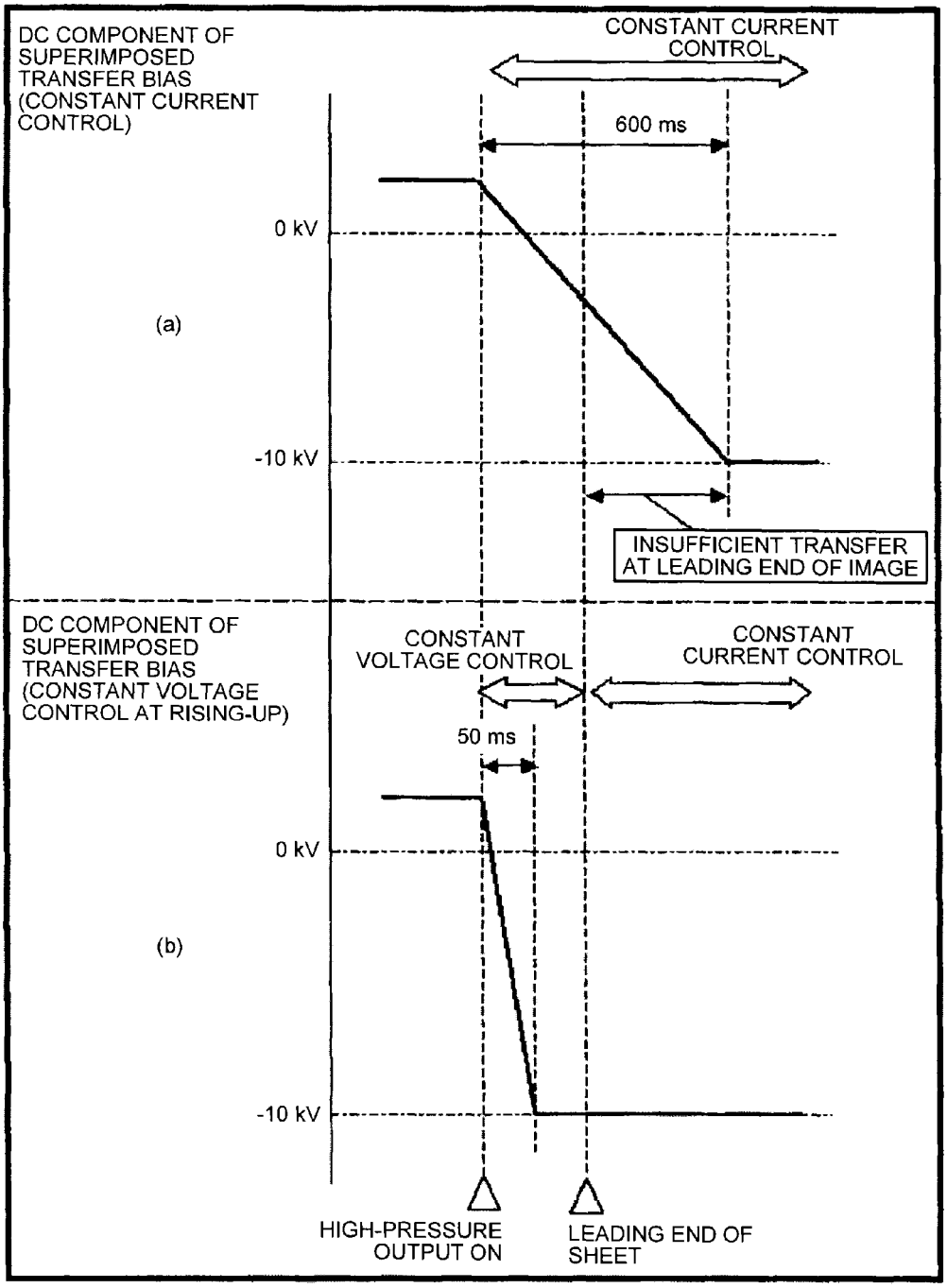
FIG. 27 illustrates (a) a rise time when the direct current component of the superimposed transfer bias rises up under constant current control, and (b) a rise time when the direct current component of the superimposed transfer bias rises up under constant voltage control.

FIG. 27 illustrates comparison of the rise time between an example in which the direct current component of the superimposed transfer bias rises up under the constant current control and an example in which the direct current component of the superimposed transfer bias rises up under the constant voltage control. In FIG. 27, (a) illustrates the rise time if the direct current component of the superimposed transfer bias rises up under constant current control. In FIG. 27, (b) illustrates the rise time if the direct current component of the superimposed transfer bias rises up under constant voltage control.

In the embodiment, if the secondary transfer bias power supply 200 is used to output the superimposed bias with a high pressure, the direct current component of the superimposed transfer bias rises up so that the bias reaches a specified target voltage determined in advance (refer to FIG. 21). This enables the direct current component of the superimposed transfer bias illustrated in (a) of FIG. 27 to reach an intended bias value with a shorter rise time than the example in which the superimposed transfer bias rises up under the constant current control, as illustrated in (b) of FIG. 27. This can reduce insufficient density of the leading end of the image due to the delay of the rise time.

Even if the gradient of the rising-up of the direct current component changes resulting from any environmental change, the direct current component can be set to an intended target voltage because the voltage is set with the target voltage itself.

In addition, after the direct current component of the transfer bias rises up under the constant voltage control so as to be a specified target voltage, the control is switched to the constant current control before the toner image on the intermediate transfer belt 31 is transferred onto the recording sheet P, so that the bias reaches a specified target current (refer to (b) and (c) of FIG. 21).

As described above, when transferring the toner image on the intermediate transfer belt 31 onto the recording sheet P, the transfer electric field is stabilized by applying the transfer bias under the constant current control, thereby achieving stable transferability even if the electric resistance of the intermediate transfer belt 31 varies depending on the environmental conditions such as the temperature and the humidity.

In FIG. 21, when the rising-up of the voltage under the constant voltage control (before the leading end of the sheet reaches the transfer nip), the secondary transfer roller 36 and the intermediate transfer belt 31 are kept separated. Before the image (the toner image) on the recording sheet P reaches the secondary transfer position, the secondary transfer roller 36 may be brought into contact with the intermediate transfer belt 31 to form the transfer nip.

When the voltage rises up under the constant voltage control (before the leading end of the sheet reaches the transfer nip), the secondary transfer roller 56 may be brought into contact with the intermediate transfer belt 51 with a smaller pressure than that at the time of transferring images, and then the pressure is increased before the image (the toner image) on the recording sheet P reaches the secondary transfer position.

In FIG. 21, when the leading end of the sheet reaches the transfer nip, the secondary transfer bias power supply 200 is switched from low voltage control to the constant current control. This is provided merely for exemplary purpose and not limiting. For another example, the secondary transfer bias power supply 200 may be switched from the constant voltage control to the constant current control after the leading end of the sheet reaches the transfer nip and before the leading end of the image reaches the transfer nip.

Various types of paper can be used as a recording sheet P for electrophotography and the optimal transfer bias for the optimal transfer varies depending on the material or thickness of the recording sheet P. In addition, the optimal transfer bias at the time of transferring the leading end of the image also varies depending on the material or thickness of the recording sheet P.

The target voltage at the rising-up under the constant voltage control is also preferably changed to the optimal voltage depending on the types of the recording sheet P, such as a thin sheet of paper and a thick sheet of paper.

If the voltage is not changed and applied constantly regardless of the type of the recording sheet P, excessive transfer occurs on a thin sheet of paper due to the bias at the time of transferring images at the leading end of the image. By contrast, on a thick sheet of paper, poor transfer may occur resulting in generating extraordinary images, such as images with white spots or insufficient density.

In the present embodiment, the target voltage is changed appropriately according to the characteristics of the recording sheet P, that is, the thickness and the type of paper, more specifically, the thickness of the recording sheet P and the difference of the surface asperity of the sheet. Examples are provided in Table 4.

TABLE 4

| | | Target voltage under constant voltage control at rising-up (−kV) | | | | |
|---|---|---|---|---|---|---|
| | | Plain paper | Glossy coated paper | Matte coated paper | Rough paper | Transparent medium |
| ↑ | Thickness 1 | 1.7 | 1.5 | 1.6 | 1.8 | 4.7 |
| Thinner | Thickness 2 | 2.0 | 1.8 | 1.9 | 2.2 | |
| | Thickness 3 | 2.3 | 2.0 | 2.2 | 2.6 | |
| | Thickness 4 | 2.7 | 2.3 | 2.5 | 2.9 | |
| | Thickness 5 | 3.0 | 2.5 | 2.7 | 3.3 | |
| | Thickness 6 | 3.3 | 2.8 | 3.0 | 3.7 | |
| Thicker | Thickness 7 | 3.7 | 3.0 | 3.3 | 4.0 | |
| ↓ | Thickness 8 | 4.0 | 3.3 | 3.6 | 4.4 | |

Disclosed in Japanese Patent Application Laid-open No. 2012-042827 is a change in the voltage of the alternating current component in the transfer bias in which the direct current component and the alternating current component are superimposed according to the type of paper or the thickness of paper. In the document, a change in the target voltage of the direct current component at the rise time is not disclosed.

In the embodiment, the target voltage at the rise time is controlled (corrected) by detecting the output voltage (the resistance of the secondary transfer unit).

The transferability depends on significantly the electric resistance of transfer members such as the secondary transfer roller 36, the repulsive roller 33, and the intermediate transfer belt 31.

Specifically, small resistance of the transfer member increases the influence from the resistance of the toner layer. Accordingly, the applied voltage varies depending on the area of images, whereby transfer efficiency varies depending on the size of image section.

Large resistance of transfer members also causes the problem that the applied voltage is so increased that leak occurs resulting in disrupting images. If the voltage reaches to the upper limit for the power supply performance, the current stops resulting in poor transfer, which may damage the power supply.

Typically, the members included in the transfer device such as the intermediate transfer belt 31 and the secondary transfer roller 36 gradually changes their resistance when the transfer bias is applied. Accordingly, if the resistance of the intermediate transfer belt 31 or the secondary transfer roller 36 changes over time, the above-described problem may occur.

In the embodiment, therefore, the transfer bias value (the direct current component of the superimposed transfer bias), the alternating current component of the superimposed transfer bias, and the target voltage at the rise time) are corrected by using the detected resistance value of the secondary transfer unit.

The control unit 300 controls both the DC power supply 201 and the AC power supply 202 illustrated in FIG. 22 by transmitting the signals of pulse width modulation (PWM) such as the constant voltage control signals or the constant current control signals. A voltage detecting unit 203 is provided only in the DC power supply 201 included in the power supply 200 together with the AC power supply 202.

The voltage detecting unit 203 detects a feedback voltage for output to the control unit 300 to use for detecting the resistance in the transfer unit.

This configuration, in which no voltage detecting unit (a circuit configuration for detecting a voltage) is included in the AC power supply 202, achieves a small-spaced power supply with a low cost.

In the present embodiment, in the DC transfer mode during which the DC bias is applied as the secondary transfer bias to transfer an image, the DC power supply 201 is used. The resistance of the secondary transfer unit is calculated based on the feedback voltage detected by the voltage detecting unit 203 to determine a transfer current value for control. The resistance value of the secondary transfer unit includes the resistance values of the intermediate transfer belt 31 and the recording sheet P. In the embodiment, the constant current control is performed.

In the embodiment, the voltage detecting unit 203 detects voltage per certain number of output (transfer).

Figure 28:
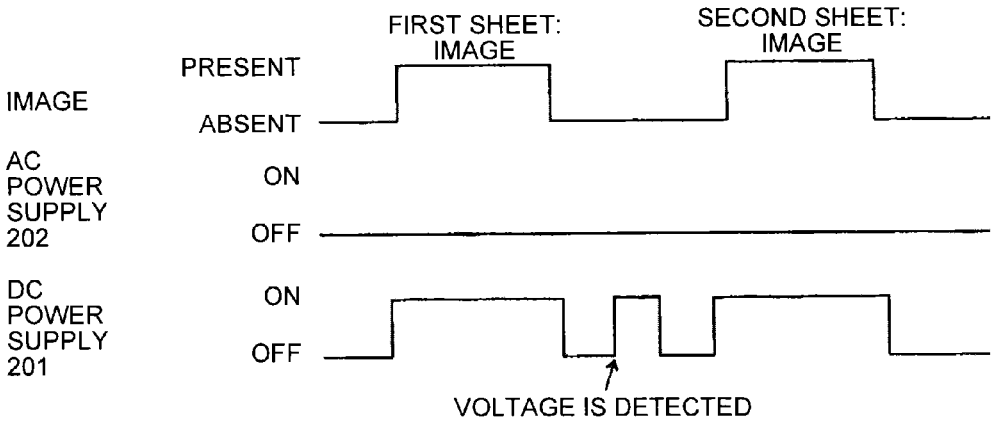
FIG. 28 is a diagram illustrating voltage detection timing when the direct current bias is applied (a DC constant current mode)

FIG. 28 illustrates a voltage detection timing when the DC bias is applied (when the DC mode is selected).

Although FIG. 28 illustrates the detection during the interval between the first sheet and the second sheet, the voltage is detected for a predetermined number of output (transfer) as described above.

Herein, although the voltage detecting unit 203 detects the voltage in the interval between successive image forming operations (during a job), the voltage detecting unit 203 may detect the voltage after the successive image forming operations (after a job).

In FIG. 28, when the voltage is detected, the output of the DC source 201 is off state. However, the output of the DC source 201 is not necessary to be turned off and the voltage can be detected by decreasing the output to some extent (changing the monitor voltage).

Basically, during a job, the secondary transfer bias power supply 200 is turned off to prevent stain of toner on the surface of the intermediate transfer belt 31 from being transferred to the secondary transfer roller. In FIG. 28, the DC power supply 201 is kept on only when voltage is detected during a job to detect the voltage (resistance).

Rather than turning off the secondary transfer bias power supply 200, reducing the output adequately can reduce stain of toner on the surface of the intermediate transfer belt 31 from being transferred to the secondary transfer roller to some extent. In addition to reducing the DC bias during a job, applying a certain amount of DC bias achieves voltage detection if necessary.

By contrast, in the superimposed transfer mode during which the superimposed bias is applied to transfer the toner image as the secondary transfer bias, because the AC power supply 202 includes no voltage detecting unit, the output voltage is detected using the DC power supply 201, thus, the resistance of the secondary transfer unit is calculated, and the output of the AC power supply 202 is controlled (corrected).

Figure 29:
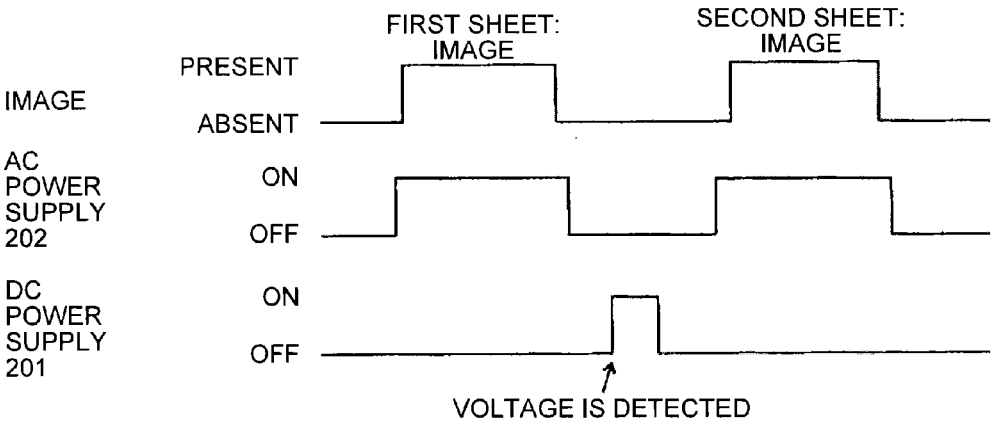
FIG. 29 is a diagram illustrating voltage detection timing when the alternating current bias (the superimposed transfer bias) is applied.

FIG. 29 is a graph illustrating the voltage detection timing when the AC bias is applied in the superimposed transfer mode.

In FIG. 29, the voltage detecting unit 203 detects the voltage in the interval between the first sheet and the second sheet; however, as described above, the voltage detecting unit 203 may detect the voltage per the predetermined number of the output (transfer).

Herein, the voltage is detected in an interval between successive image forming operations (interval between the sheets during a job), the voltage may be detected after the successive image forming operations (after a job).

As is clear from the timing chart illustrated in FIG. 29, while the output voltage is detected using the voltage detecting unit 203 in the DC power supply 201, the AC power supply 202 is turned off and the DC power supply 201 is turned on.

That is, in the superimposed transfer mode, the power supply 200 is temporarily switched from the AC power supply 202 to the DC power supply 201, and the output voltage (the resistance of the secondary transfer unit) is detected.

The voltage detecting unit 203 can detect the voltage without affecting from the output from the AC power supply 202, by turning off the AC power supply 202 when the output voltage is detected during the superimposed transfer mode.

In the present embodiment, the control unit 300 controls (corrects) the output of the power supply 200 based on the detected result of the output voltage (the resistance of the secondary transfer unit). More specifically, when the resistance is high, the control unit 300 adjusts the power supply 200 so that the output of the power supply 200 is decreased. When the resistance is low, the control unit 300 adjusts the power supply 200 so that the output of the power supply 200 is increased.

By detecting the output voltage (the resistance of the secondary transfer unit) per the predetermined number of sheet and adjusting the output of the power supply 200, desirable transferability can be kept over time.

The target voltage at the time of star-up under the constant voltage control is also corrected according to the detected output voltage (the resistance of the secondary transfer unit) in the same manner.

TABLE 5

| Resistance of roller | Detected voltage |
|---|---|
| 7.0 powers | 0.82 kV |
| 7.5 powers | 1.40 kV |
| 8.0 powers | 1.88 kV |
| 8.5 powers | 2.28 kV |
| 9.0 powers | 2.60 kV |

If the voltage is detected with a current of 25 μA, the detected results are listed in the following Table 5.

The detected voltage varies depending on the resistance value of the secondary transfer unit (the resistance of the roller, here). The voltage increases with increasing resistance, therefore, the resistance value of the transfer member can be obtained by the detected voltage value.

As described above, the resistance value of the transfer member can be determined based on whether the detected voltage is higher than a threshold value. The optimal rising-up target voltage can be set by multiplying the optimal resistance corrective coefficient by the resistance value of the transfer member.

In addition, an environmental conditions detecting unit including a not-illustrated temperature and humidity sensor for detecting at least one of the temperature and the relative humidity may be provided. The environmental conditions detecting unit detects a change in environmental conditions according to one of the temperature, the relative humidity, and the absolute humidity calculated from the temperature and the relative humidity, or according to the combination of at least two out of the temperature, the relative humidity, and the absolute humidity. If the value of change exceeds a specified value (for example, the temperature changes 5° C.), this may be the time for detecting the voltage.

Alternatively, the transfer bias (the DC bias, the superimposed bias) to be applied at the secondary transfer unit may be controlled (corrected) taking into account of the conditions detected by the environmental conditions detecting unit on the feedback voltage detection data detected in the DC transfer is applied and the superimposed bias is applied.

Examples of the environmental conditions include LL (temperature 19° C., humidity 30%), ML (temperature 23° C., humidity 30%), MM (temperature 23° C., humidity 50%), MH (temperature 23° C., humidity 80%), and HH (temperature 27° C., humidity 80%). The values and combination of the temperature and the humidity above are provided merely for exemplary purpose and not limiting.

Thus, desirable transferability can be achieved in accordance with the environmental condition. Expression 1 represents an exemplary formula for computation to calculate the target voltage under the constant voltage control taking into account of the resistance of the roller and the environmental conditions. Table 6 lists examples of the corrective coefficient for the target voltage corresponding to the relative relation between the resistance of the roller and the environmental conditions.

target voltage=standard voltage value×voltage environmental corrective coefficient×voltage resistance corrective coefficient — Expression 1

TABLE 6

| Detected voltage | Resistance of roller | LL | ML | MM | MH | HH |
|---|---|---|---|---|---|---|
| Under 1.0 kV | 7.0 powers | 110% | 100% | 90% | 80% | 70% |
| 1.0 to 1.6 kV | 7.5 powers | 120% | 110% | 100% | 90% | 80% |
| 1.6 to 2.4 kV | 8.0 to 8.5 powers | 130% | 120% | 110% | 100% | 90% |
| Over 2.4 kV | 9.0 powers | 150% | 140% | 130% | 115% | 100% |

If the resistance of the roller and the environmental conditions are not taken into account, as listed in Table 4, the target voltage on a plain sheet of paper having thickness 3 is −2.3 kV, which is determined to be the "voltage standard value" in Expression 1. If the resistance of the roller and the environmental conditions are taken into account, as illustrated in Table 6, when the detected voltage is equal to or smaller than 1.0 kV, the resistance of the roller is 7.0 powers. If in the MM environmental conditions, the corrective coefficient of the target voltage (equivalent to "voltage environmental corrective coefficient×voltage resistance corrective coefficient" in Expression 1) is 90%.

Accordingly, the target voltage taking into account of the resistance of the roller and the environmental conditions can be calculated from Expression 1, as the following: the target voltage=−2.3 kV×0.9=−2.07 kV.

Other examples of the corrective coefficient of the target voltage include a corrective coefficient for the temperature, a corrective coefficient for the humidity, a corrective coefficient for the temperature and the humidity, and a corrective coefficient for the resistance of the roller.

As described above, although the AC power supply 202 in the secondary transfer bias power supply 200 does not include a component for detecting a feedback voltage, the resistance value in the secondary transfer unit in the transfer mode in which the superimposed transfer bias is applied, thereby applying an optimal transfer device.

Accordingly, desirable transferability can be achieved based on a suitable amount of the superimposed transfer bias, with achievement of reducing space of the AC power supply 202 and reducing the cost.

The constant voltage control may be performed while detecting the voltage when the secondary transfer bias power supply 200 applies the transfer bias so that the transfer bias reaches the target voltage.

More specifically, desirable transferability can be achieved using the superimposed transfer bias for a large-asperity recording sheet P. Thus, by switching application of the direct current bias for a small-asperity sheet P such as a plain transfer sheet of paper and application of the superimposed transfer bias for a large-asperity recording sheet P, desirable transferability can be achieved for various types of recording sheet.

When using a small-asperity sheet P and if only the direct current bias rather than the alternating current bias in the secondary transfer bias power supply 200 illustrated in FIG. 22 is applied, the direct current bias rises up under the constant voltage control so as to reach the target voltage. After the direct current bias rises up under the constant voltage control so as to reach a predetermined target voltage, the control is switched to the constant current control so as to reach a predetermined target current before the toner image on the intermediate transfer belt 51 is transferred onto the recording sheet P.

If only the direct current bias rather than the alternating current bias is applied and the direct current bias rises up under the constant current control, as described above, the capacitor for adjusting the load included in the AC power supply 202 requires a longer time for rising-up of the direct current component.

To address this, if only the direct current bias rather than the alternating current bias in the secondary transfer bias power supply 200 illustrated in FIG. 22 is applied, rising-up of the direct current bias under the constant voltage control requires a shorter rise time than rising-up of the direct current bias under the constant current control so as to reach an intended bias value. This reduces insufficient density at the leading end of the image resulting from the longer rise time.

Furthermore, voltage can be detected when applying the direct current bias and when applying the superimposed transfer bias for calculating the resistance value in the secondary transfer unit. This achieves appropriate bias control with an appropriate transfer current value according to the resistance value, which varies depending on environmental conditions.

It is to be noted that, when the DC bias is applied and the superimposed transfer bias is applied, although the voltage is detected every predetermined number of sheet (in a print job), the detection timing is not limited to this. For example, the voltage may be detected after a job in which a predetermined number of sheet are printed, when rising-up of the image forming apparatus, or and before control of adjusting image in which image forming conditions are adjusted, as necessary.

In the image forming apparatus disclosed in Japanese Patent Application Laid-open No. 7-168403, the transfer voltage is detected and measured in an adjustment mode at the time of shipping of the product from the factory and in an adjustment mode at the time of maintenance and inspection at the market. The detected and measured results are stored in a memory. When forming images, the transfer power supply that outputs only the DC voltage is subject to the constant voltage control for rising-up of the voltage so as to reach the transfer voltage value stored in the memory. If the type of paper or the thickness of paper, or the environmental conditions change, the apparatus cannot adapt to the change immediately.

By contrast, in the image forming apparatus according to the embodiment, the voltage can rise up with an optimal target voltage according to printing conditions such as the type of paper or the thickness of paper and the environmental conditions without using the adjustment mode. If the type of paper or the thickness of paper, or the environmental conditions change, the apparatus can immediately adapt to the change automatically.

In addition to changing the target voltage value according to printing conditions, the time period for controlling the direct current component of the transfer bias at the rise time under the constant voltage control may be changed.

As described above, various types of paper can be used as a recording sheet P for electrophotography and the optimal transfer bias for the optimal transfer varies depending on the material or thickness of the recording sheet P. In addition, the optimal transfer bias at the time of transferring the leading end of the image also varies depending on the material or thickness of the recording sheet P.

To address this, as described above, the target voltage at the rise time under the constant current control is set to the optimal target voltage according to printing conditions, thereby achieving desirable transfer. However, the time required for reaching the target voltage at the rise time varies depending on the different target voltages.

Figure 30:
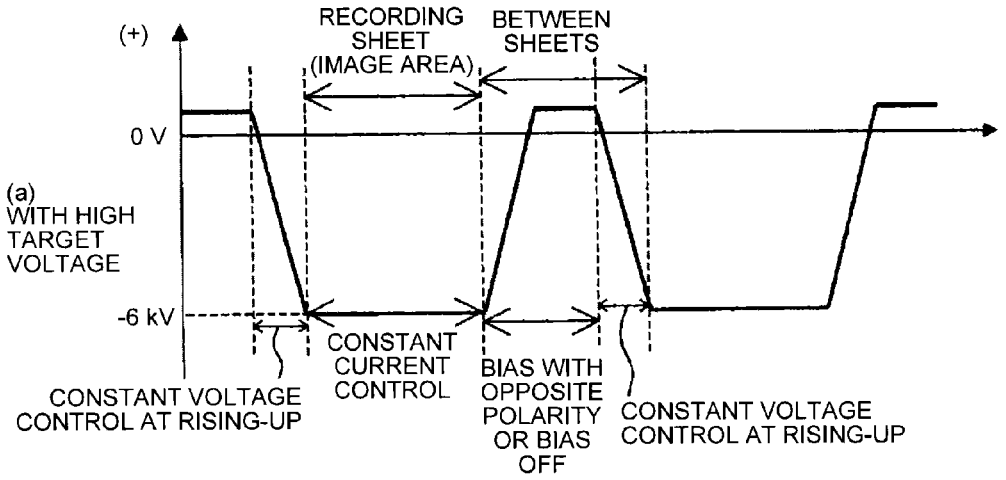
FIG. 30 illustrates (a) a rise time when a target voltage value is high and (b) a rise time if a target voltage value is low.
Figure 30:
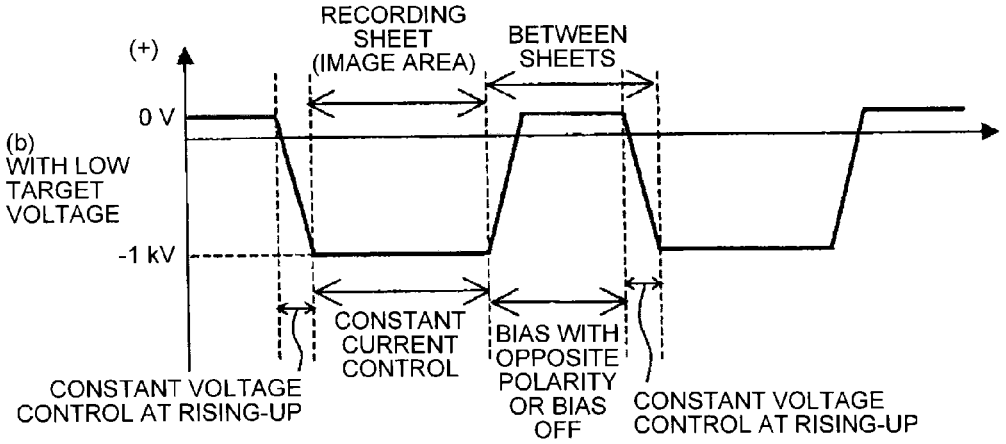

In FIG. 30, (a) illustrates a rise time with a large target voltage value and (b) illustrates a rise time with a small target voltage value.

In a low-temperature and low-humidity environment as printing conditions, increased resistance of the transfer member and the recording sheet P increase the optimal transfer bias value. This also increases the target voltage value at the rise time, and as illustrated in (a) of FIG. 30, increases the time period required for reaching the high target voltage.

By contrast, in a high-temperature and high-humidity environment as printing conditions, decreased resistance of the transfer member and the recording sheet P decrease the optimal transfer bias value. This also decreases the target voltage value at the rise time, and as illustrated in (b) of FIG. 30, decreases the time period required for reaching the low target voltage.

To ensure the time period required for reaching the target voltage at the rise time, which varies depending on printing conditions, the time period for controlling the direct current component of the transfer bias at the rise time under the constant voltage control, is therefore, changed according to printing conditions.

Specifically, examples of printing conditions includes the type of paper and the thickness of paper, the environmental conditions such as the temperature and the humidity, or a change in the resistance of the transfer material such as the secondary transfer roller 36, the repulsive roller 33, and the intermediate transfer belt 31.

To address a change in the transfer material, a change in the transfer material resulting from environmental conditions and use over time is detected through the above-described methods, based on the detected result of which, the time required for the constant voltage control at the rise time.

Environmental conditions also change the gradient of the rising-up of the direct current component in addition to a change in the resistance of the transfer material. This is because environmental conditions change the electrostatic capacity of the transfer member. For example, increased electrostatic capacity eases the gradient at the rise time in a high-temperature and high-humidity environment.

Changing the time period for controlling the direct current component of the transfer bias at the rise time under the constant voltage control according to the printing conditions ensures the time period required for reaching the target voltage at the rise time, thereby achieving desirable transfer at the optimal transfer bias. This decreases occurrence of uneven density on a sheet of paper having large asperity, or reduces insufficient density at the leading end of the image, for example.

By contrast, as illustrated in FIG. 30, the polarity of bias opposite to that of the bias at the time of transfer is preferably applied to the secondary transfer roller 36 or the secondary transfer bias power supply 200 is preferably turned off during the time period except for the time period required for rising-up in the interval between a sheet and a subsequent sheet, so that the toner adhering on the intermediate transfer belt 51 is not transferred onto the surface of the secondary transfer roller 56. This reduces the toner adhering to the surface the secondary transfer roller 36 from adhering to the rear surface of the recording sheet P in the secondary transfer unit, thereby reducing stain on the rear surface of the recording sheet P.

In particular, applying the opposite bias to the secondary transfer roller 36 in the interval between a sheet and a subsequent sheet enables any particles of toner on the surface of the secondary transfer roller 36, if any, to transfer from the surface of the secondary transfer roller 56 onto the intermediate transfer belt 31. The toner transferred and adhering onto the intermediate transfer belt 31 is removed by the belt cleaning device. This ensures cleanability of the secondary transfer roller 36 and so forth in the interval between a sheet and a subsequent sheet.

Performing the above-described control in the interval between a sheet and a subsequent sheet ensures cleanability of the secondary transfer roller 36 and so forth in the interval between a sheet and a subsequent sheet and decreases occurrence of uneven density on a sheet of paper having large asperity, or reduces insufficient density at the leading end of the image, for example.

The embodiments and modification have been described by way of example only, and the present invention has specific advantageous effects for each of the following aspects.

Aspect A

A transfer device including: a nip forming member such as the secondary transfer roller 36 that comes into contact with an image carrier such as the intermediate transfer belt 31 to form a transfer nip such as the secondary transfer nip; and a transfer bias power supply such as the secondary transfer bias power supply 200 in which a DC power supply such as the DC power supply 201 and an AC power supply such as the AC power supply 202 are electrically coupled to each other and outputs a transfer bias. In the transfer device such as the transfer unit 30, the transfer bias output by the transfer bias power supply transfers a toner image on the image carrier onto a recording sheet such as the recording sheet P sandwiched in the transfer nip. The transfer bias power supply causes the direct current component of the transfer bias to rise up under constant voltage control so as to reach a specified target voltage value determined in advance and then switches the control to constant current control so as to reach a specified target current value determined in advance before the toner image on the image carrier is transferred onto the recording sheet.

In Aspect A, the transfer device causes the direct current component of the transfer bias to rise up under the constant voltage control so as to reach a specified target voltage value determined in advance. This enables the direct current component to rise more steeply to the target voltage than the example in which the direct current component rises up under the constant current control. This decreases the time for rising-up of the direct current component to reach the target voltage.

The voltage value of the direct current component at the rise time is set based on the target voltage itself rather than the rise time. Therefore, even if the gradient of the rising-up of the direct current component changes resulting from any environmental change, the direct current component can be raised to reach an intended target voltage.

This reduces insufficient density at the leading end of the image due to the shortage of the transfer bias resulting from a delay of rising-up of the bias before reaching the target voltage.

When toner images on the image carrier are transferred onto the recording sheet, the transfer bias is applied under the constant current control. This stabilizes the transfer electric field in the transfer nip even if the electric resistance of the image carrier, the nip forming member, and the like varies, thereby achieving stable transferability.

This reduces poor transfer that occurs when a transfer bias power supply is used in which a DC power supply and an AC power supply are electrically coupled to each other.

Aspect B

In Aspect A, the target voltage under the constant voltage control is changed according to the thickness of the recording medium. This achieves desirable transferability, as described in the embodiment above, regardless of the thickness of the recording medium.

Aspect C

In Aspect A or Aspect B, the target voltage under the constant voltage control is changed according to the type of the recording medium. This achieves desirable transferability, as described in the embodiment above, regardless of the type of the recording medium.

Aspect D

In Aspect A, Aspect B, or Aspect C, the transfer device includes a temperature and/or humidity detecting unit that detects at least one of the temperature and the humidity, such as an environmental conditions detecting unit. The target voltage under the constant voltage control is changed according to at least one of the temperature and the humidity detected by the temperature and/or humidity detecting unit. This achieves desirable transferability, as described in the embodiment above, regardless of the temperature and/or humidity.

Aspect E

In Aspect A, Aspect B, Aspect C, or Aspect D, the transfer device includes a resistance detecting unit that detects the electric resistance of a member forming a transfer nip. The target voltage under the constant voltage control is changed according to the electric resistance detected by the resistance detecting unit. This achieves desirable transferability, as described in the embodiment above, regardless of the electric resistance.

Aspect F

In Aspect A, Aspect B, Aspect C, Aspect D, or Aspect E, the time period for controlling the direct current component of the transfer bias at the rise time under the constant voltage control according to the printing conditions. This ensures, as described in the embodiment above, cleanability between recording media, decreases occurrence of uneven density on a sheet of paper having large asperity, and reduces insufficient density at the leading end of an image.

Aspect G

In Aspect F, the printing conditions include at least one of the type of the recording medium and the thickness of the recording medium. This enables the apparatus to set, as described in the embodiment above, an optimal time period for rising-up of the direct current component according to the type of the recording medium and/or the thickness of the recording medium.

Aspect H

In Aspect F or Aspect G, the printing conditions include at least one of the temperature and the humidity detected by the temperature and/or humidity detecting unit. This enables the apparatus to set, as described in the embodiment above, an optimal time period for rising-up of the direct current component according to the temperature and/or the humidity.

Aspect I

In Aspect F, Aspect G, or Aspect H, the printing conditions include the electric resistance of a member forming a transfer nip. This enables the apparatus to set, as described in the embodiment above, an optimal time period for rising-up of the direct current component according to the electric resistance.

Aspect J

In Aspect A, Aspect B, Aspect C, Aspect D, Aspect E, Aspect F, Aspect G, Aspect H, or Aspect I, the bias applying unit applies only a direct current component of a transfer bias rather than an alternating current component of a superimposed transfer bias depending on the type of the recording medium. This can reduce, as described in the embodiment above, generation of transfer dust particles.

Aspect K

An image forming apparatus such as a printer forms an image on the surface of an image carrier such as the intermediate transfer belt 31 and transfers the formed image onto a recording medium such as the recording sheet P by using a transfer unit. The image forming apparatus includes the transfer device described in Aspect A, Aspect B, Aspect C, Aspect D, Aspect E, Aspect F, Aspect G, Aspect H, Aspect I, or Aspect J. This reduces, as described in the embodiment above, poor transfer that occurs when a transfer bias power supply is used in which a DC power supply and an AC power supply are electrically coupled to each other, thereby achieving desirable image formation.

The first embodiment and the second embodiment may be combined. For example, an image forming apparatus includes: an image carrier that carries a toner image; a transfer member that forms a transfer nip between itself and the image carrier; a power supply capable of outputting a superimposed transfer bias in which an alternating current component is superimposed onto a direct current component; and a control unit that controls the power supply. The superimposed transfer bias or a direct current bias consisting of the direct current component output by the power supply transfers the toner image on the image carrier onto a recording medium in the transfer nip. The control unit controls the power supply so that the output target value of the direct current component at the rise time of the direct current component is larger than the output target value of the direct current component at the time of transferring the toner image onto a recording medium. After the direct current component of the transfer bias rises up under the constant voltage control so as to be a specified target voltage, the control unit switches the control to the constant current control so as to reach a specified target current value determined in advance before the toner image on the image carrier is transferred onto a recording medium. This configuration provides both the advantageous effects described in the first embodiment and the second embodiment.

According to an aspect of the embodiments, it is possible to cause the direct current component of the transfer bias to quickly rise up and to acquire high-quality images while providing sufficient image density on both the recessed portions and the protruding portions on the surface of a recording sheet P, without decreasing the image density at the leading end of the recording sheet.

According to an aspect of the embodiments, it is possible to provide the advantageous effect of reducing insufficient transfer when a transfer bias power supply is used in which a DC power supply and an AC power supply are electrically coupled to each other.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an image carrier that carries a toner image;

a transfer member that forms a transfer nip between the transfer member and the image carrier;

a power supply that outputs a superimposed transfer bias in which an alternating current component is superimposed onto a direct current component, the toner image on the image carrier being transferred onto a recording medium in the transfer nip by the superimposed transfer bias or a direct current bias consisting of the direct current component output by the power supply; and a controller that controls the power supply so that an output target value of the direct current component when the direct current component rises up is larger than an output target value of the direct current component when the toner image is transferred onto the recording medium, wherein the output target value of the direct current component when the direct current component rises up includes a first output target value that is an output target value in a first period, and a second output target value that is an output target value in a second period after the first period and less than the first output target value, and the first period and the second period start before the recording medium enters the transfer nip.

2. The image forming apparatus according to claim 1, wherein the second output target value is larger than the output target value of the direct current component when the toner image is transferred onto the recording medium.

3. The image forming apparatus according to claim 1, wherein a maximum output target value out of output target values of the direct current component when the direct current component rises up is 300% or larger of the output target value of the direct current component when the toner image is transferred onto the recording medium.

4. The image forming apparatus according to claim 3, wherein the direct current component when the toner image is transferred onto the recording medium is controlled under constant current control.

5. The image forming apparatus according to claim 1, wherein the toner image on the image carrier is transferred onto the recording medium in the transfer nip by the direct current bias output by the power supply.

6. The image forming apparatus according to claim 1, wherein the toner image on the image carrier is transferred onto the recording medium in the transfer nip by the superimposed transfer bias output by the power supply.

7. The image forming apparatus according to claim 1, further comprising an environmental conditions detecting device that detects environmental conditions, wherein the controller controls a rise time of the direct current component according to a detected result of the environmental conditions detecting device.

8. The image forming apparatus according to claim 1, further comprising a resistance detecting device that detects an electric resistance of a member forming the transfer nip, wherein the controller controls a rise time of the direct current component according to a detected result of the resistance detecting device.

9. The image forming apparatus according to claim 8, wherein the controller controls the rise time of the direct current component so as to be longer with increasing electric resistance of the member forming the transfer nip detected by the resistance detecting device.

10. The image forming apparatus according to claim 1, wherein the second output target value is at least 120% of the output target value of the direct current component when the toner image is transferred onto the recording medium.

11. An image forming apparatus comprising:

an image carrier that carries a toner image;

a transfer member that forms a transfer nip between the transfer member and the image carrier;

a counter member facing the transfer member with the image carrier interposed therebetween in the transfer nip;

a power supply that outputs to the transfer member or the counter member a superimposed transfer bias in which an alternating current component is superimposed onto a direct current component, the toner image on the image carrier being transferred onto a recording medium in the transfer nip by the superimposed transfer bias or a direct current bias consisting of the direct current component output by the power supply; and a controller that controls the power supply so that an absolute value of a peak value of the direct current component to the transfer member or the counter member when the direct current component rises up is larger than an absolute value of an output of the direct current component to the transfer member or the counter member when the toner image is transferred onto the recording medium, wherein the peak value of the direct current component is reached during a period before the recording medium enters the transfer nip.

12. The image forming apparatus according to claim 11, wherein the peak value of the direct current component is at least 300% of the output target value of the direct current component when the toner image is transferred onto the recording medium.

13. An image forming apparatus comprising:

an image carrier that carries a toner image;

a transfer member that forms a transfer nip between the transfer member and the image carrier;

a power supply that outputs to the transfer member a superimposed transfer bias in which an alternating current component is superimposed onto a direct current component, the toner image on the image carrier being transferred onto a recording medium in the transfer nip by the superimposed transfer bias or a direct current bias consisting of the direct current component output by the power supply; and a controller that controls the power supply so that an absolute value of a peak value of the direct current component to the transfer member when the direct current component rises up is larger than an absolute value of an output of the direct current component to the transfer member when the toner image is transferred onto the recording medium, wherein the peak value of the direct current component is reached during a period before the recording medium enters the transfer nip.

14. A transfer device comprising:

a nip forming member that comes into contact with an image carrier to form a transfer nip;

a transfer bias power supply in which a direct-current power supply and an alternating-current power supply are electrically coupled to each other, the transfer bias power supply outputting a transfer bias, a toner image on the image carrier being transferred onto a recording medium sandwiched in the transfer nip by the transfer bias output by the transfer bias power supply; and a controller that:

controls the transfer bias power supply so that the direct current component of the transfer bias is switched to constant current control so as to reach a specified target current value determined in advance before the toner image on the image carrier is transferred onto the recording medium after the direct current component of the transfer bias rises up to a specified target voltage value determined in advance under constant voltage control; and changes a time period for controlling the direct current component of the transfer bias during rising up under the constant voltage control, depending on printing conditions.

15. The transfer device according to claim 14, wherein the controller changes the specified target voltage value under the constant voltage control depending on a thickness of the recording medium.

16. The transfer device according to claim 14, wherein the controller changes the specified target voltage value under the constant voltage control depending on a type of the recording medium.

17. The transfer device according to claim 14, further comprising a temperature/humidity detecting device that detects at least one of temperature and humidity, wherein the controller changes the specified target voltage value under the constant voltage control depending on at least one of the temperature and the humidity detected by the temperature/humidity detecting device.

18. The transfer device according to claim 14, further comprising a resistance detecting device that detects an electric resistance of a member forming the transfer nip, wherein the controller changes the specified target voltage value under the constant voltage control depending on the electric resistance detected by the resistance detecting device.

19. The transfer device according to claim 14, wherein the controller controls the transfer bias power supply to apply only a direct current component of a transfer bias rather than an alternating current component of a superimposed transfer bias, depending on a type of the recording medium.

20. An image forming apparatus comprising the transfer device according to claim 14 for transferring the image formed on a surface of the image carrier onto the recording medium.

* * * * *